US009206616B2

(12) United States Patent
Sarlis et al.

(10) Patent No.: US 9,206,616 B2
(45) Date of Patent: Dec. 8, 2015

(54) NEGATIVE STIFFNESS DEVICE AND METHOD

(71) Applicants: The Research Foundation for The State University of New York, Amherst, NY (US); Taylor Devices, Inc., North Tonawanda, NY (US)

(72) Inventors: Apostolos A. Sarlis, Houston, TX (US); Michael C. Constantinou, Amherst, NY (US); David A. Lee, Santa Monica, CA (US); Andrei M. Reinhorn, Williamsville, NY (US); Douglas P. Taylor, N. Tonawanda, NY (US)

(73) Assignees: THE RESEARCH FOUNDATION FOR THE STATE UNIVERSITY OF NEW YORK, Amherst, NY (US); TAYLOR DEVICES, INC., North Tonawanda, NY (US)

( * ) Notice: Subject to any disclaimer, the term of this patent is extended or adjusted under 35 U.S.C. 154(b) by 0 days.

(21) Appl. No.: 14/319,138

(22) Filed: Jun. 30, 2014

(65) Prior Publication Data

US 2015/0000217 A1 Jan. 1, 2015

Related U.S. Application Data

(60) Provisional application No. 61/840,897, filed on Jun. 28, 2013.

(51) Int. Cl.
*E04B 1/98* (2006.01)
*E04H 9/02* (2006.01)

(52) U.S. Cl.
CPC ..... *E04H 9/021* (2013.01)

(58) Field of Classification Search
CPC ..... E04H 9/00; E04H 9/02; E04H 9/021; E04H 9/028; E04H 2009/026; E04C 3/18; E04B 1/98; E04B 1/985; E02D 27/34; E02D 31/08; F16F 15/00; F16F 15/02
See application file for complete search history.

(56) References Cited

U.S. PATENT DOCUMENTS 1,158,932 A 11/1915 Kohl
2,035,009 A 3/1936 Rager
(Continued)

FOREIGN PATENT DOCUMENTS

JP 10008769 1/1998
JP 10238164 9/1998
(Continued)

OTHER PUBLICATIONS

Lee, C.-M., Design of Springs with "Negative" Stiffness to Improve Vehicle Driver Vibration Isolation, Journal of Sound and Vibration, 865-874, vol. 302 (2007).
(Continued)

*Primary Examiner* — Brian D Mattei
(74) *Attorney, Agent, or Firm* — Hodgson Russ LLP

(57) ABSTRACT

Negative stiffness systems and methods for seismic protection of a structure is described. A system can include a negative stiffness device having a first linkage pivotably connected to an anchor frame at a first pivot point and pivotably connected the movement frame at a second pivot point. The negative stiffness device can include a spring having a first end operably coupled to the anchor frame and a second end operably coupled to a movement frame. In a rest state, the spring can be compressed to exert a preload force to the first linkage and the anchor frame and not displace the first linkage and the movement frame. In an engaged state, the spring can be configured to apply a force to the first linkage such that the movement frame is displaced in a same lateral direction of a seismic load. The spring force can be amplified by the first linkage.

20 Claims, 17 Drawing Sheets

(56) References Cited

U.S. PATENT DOCUMENTS

| | | | | |
|---|---|---|---|---|
| 2,055,000 | A | 9/1936 | Bacigalupo | |
| 3,771,270 | A | 11/1973 | Byers | |
| 4,402,483 | A | 9/1983 | Kurabayashi | |
| 4,527,365 | A | 7/1985 | Yoshizawa et al. | |
| 4,565,039 | A | 1/1986 | Oguro et al. | |
| 4,586,361 | A | 5/1986 | Reinhorn et al. | |
| 4,595,373 | A | 6/1986 | Giroux | |
| 4,651,481 | A | 3/1987 | Csak | |
| 4,799,339 | A | 1/1989 | Kobori et al. | |
| 4,890,430 | A | 1/1990 | Kobori et al. | |
| 4,922,667 | A | 5/1990 | Kobori et al. | |
| 5,005,326 | A | 4/1991 | Ishimaru et al. | |
| 5,025,599 | A | 6/1991 | Ishii | |
| 5,025,600 | A | 6/1991 | Sugimoto | |
| 5,036,633 | A | 8/1991 | Kobori | |
| 5,347,772 | A | 9/1994 | Ishimaru | |
| 5,386,671 | A | 2/1995 | Hu et al. | |
| 5,456,047 | A | 10/1995 | Dorka | |
| 5,462,141 | A | 10/1995 | Taylor | |
| 5,560,162 | A | 10/1996 | Kemeny | |
| 5,660,007 | A | 8/1997 | Hu et al. | |
| 5,669,594 | A | 9/1997 | Platus et al. | |
| 5,765,313 | A | 6/1998 | Lee | |
| 5,819,484 | A | 10/1998 | Kar | |
| 5,845,438 | A | 12/1998 | Haskell | |
| 5,915,676 | A | 6/1999 | Abiru et al. | |
| 5,979,126 | A | 11/1999 | Kurino | |
| 6,098,969 | A | 8/2000 | Nagarajaiah | |
| 6,233,884 | B1 | 5/2001 | Tipping et al. | |
| 6,247,275 | B1 * | 6/2001 | Taylor | 52/167.3 |
| 6,405,493 | B1 | 6/2002 | Taylor | |
| 6,530,182 | B2 | 3/2003 | Fanucci | |
| 6,672,573 | B2 | 1/2004 | Berton | |
| 6,676,101 | B2 | 1/2004 | Platus | |
| 6,971,795 | B2 | 12/2005 | Lee | |
| 7,441,376 | B2 | 10/2008 | Ishimaru et al. | |
| 7,774,996 | B2 | 8/2010 | Mualla | |
| 8,117,788 | B1 | 2/2012 | Mueller | |
| 2002/0129568 | A1 | 9/2002 | Oka | |
| 2003/0099413 | A1 | 5/2003 | Lee | |
| 2003/0205008 | A1 | 11/2003 | Sridhara et al. | |
| 2003/0223659 | A1 | 12/2003 | Lee | |
| 2004/0074161 | A1 | 4/2004 | Kasai et al. | |
| 2004/0107654 | A1 | 6/2004 | Powell | |
| 2005/0115170 | A1 | 6/2005 | Mualla | |
| 2005/0138870 | A1 * | 6/2005 | Ishimura et al. | 52/167.1 |
| 2006/0037257 | A1 | 2/2006 | Newland | |
| 2006/0179729 | A1 | 8/2006 | Li | |
| 2008/0098670 | A1 | 5/2008 | Hsu | |
| 2008/0250746 | A1 * | 10/2008 | Nawrotski | 52/653.1 |
| 2009/0013619 | A1 | 1/2009 | Marroquin | |
| 2010/0043317 | A1 | 2/2010 | Mualla | |
| 2011/0239551 | A1 | 10/2011 | Goto | |
| 2012/0038091 | A1 | 2/2012 | Tagawa | |
| 2012/0047822 | A1 | 3/2012 | Zeevi | |
| 2012/0159876 | A1 | 6/2012 | Loewen | |
| 2012/0167490 | A1 * | 7/2012 | Balducci | 52/167.3 |
| 2012/0174500 | A1 | 7/2012 | Yakoub | |
| 2012/0260586 | A1 | 10/2012 | Thubota | |
| 2013/0118098 | A1 | 5/2013 | Constantinou et al. | |
| 2014/0191104 | A1 * | 7/2014 | Meisel et al. | 248/624 |

FOREIGN PATENT DOCUMENTS

| | | |
|---|---|---|
| JP | 11351315 | 12/1999 |
| JP | 2000055117 | 2/2000 |
| JP | 2000304090 | 10/2000 |
| JP | 2002286088 | 10/2002 |
| JP | 2003049557 | 2/2003 |
| JP | 2003278827 | 10/2003 |
| JP | 2005030573 | 2/2005 |
| WO | 2011029749 | 3/2011 |

OTHER PUBLICATIONS

Molyneux, W.G., Supports for Vibration Isolation, Ministry of Supply, Aeronautical Research Council Current Papers, CP No. 322 (1956).

* cited by examiner

90 Fig. 5A

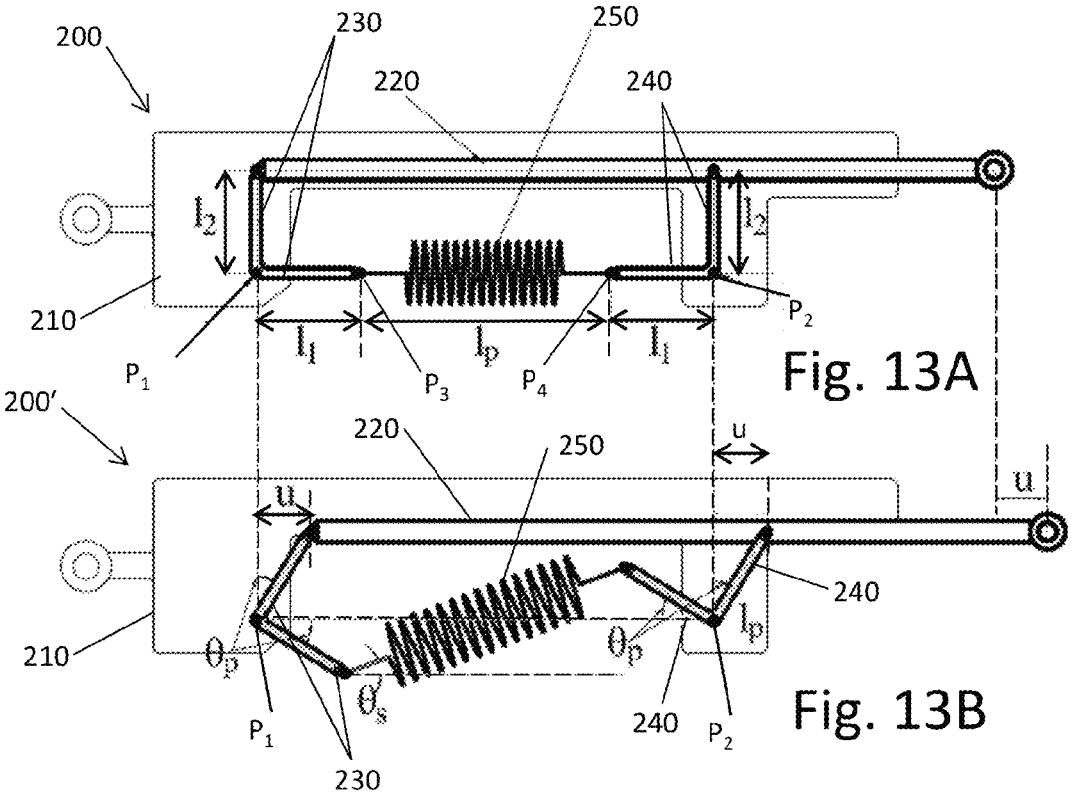
Fig. 13A
Fig. 13B
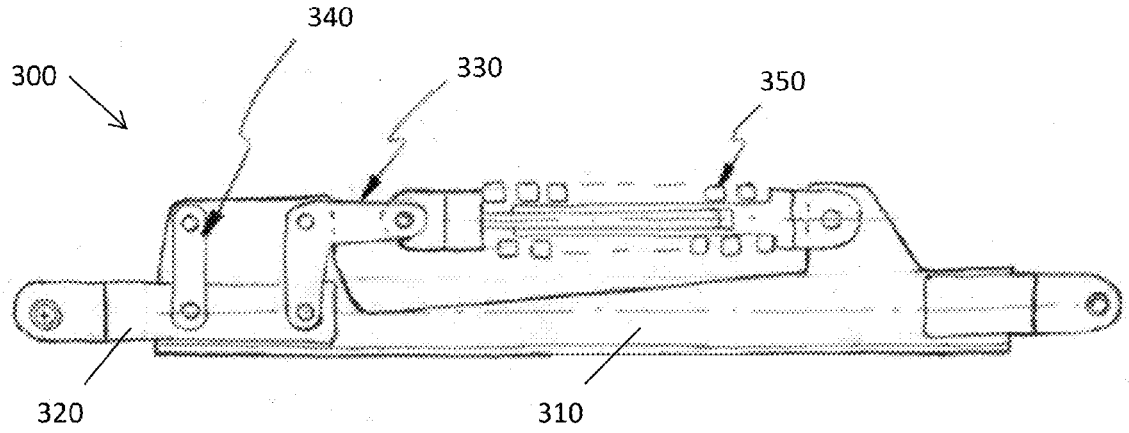
Fig. 14

NEGATIVE STIFFNESS DEVICE AND METHOD

CROSS-REFERENCE TO RELATED APPLICATION

This application claims the benefit of priority to U.S. Provisional Patent Application No. 61/840,897 filed Jun. 28, 2013, the disclosure of which is incorporated herein by reference in its entirety.

STATEMENT REGARDING FEDERALLY RESEARCH

This invention was made with government support under Grant No.CMMI0830391awarded by National Science Foundation. The government has certain rights in the invention.

FIELD OF THE INVENTION

The invention relates to apparatuses for isolating large structures and structural members from seismic forces.

BACKGROUND OF THE INVENTION

Systems and devices for improving structural response to earthquakes are based on the principle of seismic isolation, in which energy is generally dissipated by mechanical dissipating devices. In order to prevent damage to maintain structural components, large horizontal displacements must be accommodated. For example, passive systems have been used for this purpose, including devices having lead cores within lead-rubber bearings, frictional sliding bearings, and other supplemental mechanical energy-dissipating devices such as steel, viscous, or visco-elastic dampers.

The use of active-control structures that attenuate excessive structural movement by hydraulic actuators are also known. The force exerted by the actuator is calculated in real-time using a control algorithm and feedback from sensors. Although this approach has shown to be effective, its applications are limited due to its high-power and continuous feedback signal requirements. Consequently, a considerable amount of recent research has focused on the use semi-active control strategies, which combine features of both passive and active control systems.

A vibration isolation concept, which relies on a spring arrangement with a non-linear stiffness that provides zero, or very small stiffness for a limited range of movement is known in the art. A "true" negative stiffness means that a force is introduced to assist motion, not oppose it. Negative stiffness devices have been applied to the development of vibration isolation systems for small, highly sensitive equipment (e.g., U.S. Pat. No. 6,676,101) and to seats in automobiles (Lee, C. M., Goverdovskiy, V. N. and Temnikov, A. I., "Design of springs with negative stiffness to improved vehicle driver vibration isolation", Journal of Sound and Vibration, 302 (4), p. 865-874 (2007)). To date, however, this technology has been restricted to small mass applications because of the requirement for large forces to develop the necessary low or negative stiffness. The preload forces necessary to achieve negative stiffness are typically of the order of the weight being isolated. Thus, the application of negative-stiffness to a massive structure, like buildings and bridges, would require a spring force on the order of the weight of the massive structure. Such large spring forces would provide forces that would be physically very difficult and economically prohibitive to contain.

Negative stiffness concepts have been applied to isolating structures, but the concepts advanced have drawbacks. One concept advanced is a pseudo negative stiffness system where active or semi-active hydraulic devices are used to produce negative stiffness. However, such systems are complicated, and require high-power and continuous feedback in order to drive the active or semi-active hydraulic devices. Another example is a system in which a structure is placed on top of convex pendulum bearings. In this system, negative stiffness is generated due to the structure's vertical loads applied on the convex surface while elastomeric bearings placed in parallel provide positive stiffness. However, this system generates low effective stiffness that emulates the behavior of friction pendulum bearings. Complications of this system may arise due to the fact that the vertical loads are transferred through an unstable system, which generates constant negative stiffness for all displacement amplitudes.

BRIEF SUMMARY OF THE INVENTION

The present invention can be embodied as a system, device, or method, which introduces negative stiffness to cooperate with motion, for example, motion caused by seismic activity, rather than to oppose such motion. The present invention can be a passive mechanical system that generates negative stiffness, meaning that it does not require external power supply. Because the preload forces for applying the principle of negative stiffness to a massive structure, such as a building or bridge, would require preload forces that are typically of the order of the weight of the structure, the present invention can be configured to significantly reduce the demand for preload spring force, and can "package" the negative stiffness in a device that does not impose additional loads on the structure (other than those loads needed for achieving the goal of seismic protection).

In one embodiment, a negative stiffness device for seismic protection of a structure has an anchor frame and a movement frame laterally translatable relative to the anchor frame. The anchor frame and movement frame have respective extension portions. A linkage is pivotably connected to the extension portion of the anchor frame. A compressed spring has a first end attached to the extension portion of the movement frame and a second end attached to the linkage. The compressed spring has a spring force. In a rest state, the compressed spring does not apply a lateral force to the movement frame. In an engaged state, the compressed spring is configured to apply a lateral force to displace the movement frame in a lateral direction of a seismic load. The spring force is amplified by the linkage when the movement frame is laterally displaced to an amplification point.

In another embodiment, a method of protecting a structure from seismic activity includes providing at least one negative stiffness device. The negative stiffness device has an anchor frame and a movement frame. The movement frame is laterally translatable relative to the anchor frame. The anchor frame has an extension portion extending in the direction of the movement frame, and the movement frame has an extension portion extending in the direction of the anchor frame. The negatives stiffness device also includes a linkage pivotably connected to the extension portion of the anchor frame and a compressed spring having a first end attached to the extension portion of the movement frame and a second end attached to the linkage. The compressed spring has a spring force. The at least one negative stiffness device is configured to have a rest state where the compressed spring does not apply a lateral force to the movement frame and configured to have an engaged state where the compressed spring applies a lateral force to the movement frame such that the movement frame is displaced in a lateral direction of a seismic load. The linkage is configured to amplify the spring force when the movement frame is laterally displaced to an amplification point. The at least one negative stiffness device is installed at the base of a multi-story structure.

In another embodiment, a negative stiffness system, such as a brace system, can include a negative stiffness device having a first linkage pivotably connected to an anchor frame at a first pivot point and pivotably connected the movement frame at a second pivot point. The negative stiffness device can include a spring having a first end operably coupled to the anchor frame and a second end operably coupled to a movement frame. In a rest state, the spring can be compressed to exert a preload force to the first linkage and the anchor frame and not displace the first linkage and the movement frame. In an engaged state, the spring can be configured to apply a force to the first linkage such that the movement frame is displaced in a same lateral direction of a seismic load. The spring force can be amplified by the first linkage.

DESCRIPTION OF THE DRAWINGS

For a fuller understanding of the nature and objects of the invention, reference should be made to the following detailed description taken in conjunction with the accompanying drawings, in which:

FIG. 5A shows a negative stiffness device according to an embodiment of the present invention in a rest state.

FIGS. 13A and 13B are diagrams of an exemplary negative stiffness brace system.

FIG. 14 is a diagram of a second embodiment of a negative stiffness brace system.

DETAILED DESCRIPTION OF THE INVENTION

Figure 1:
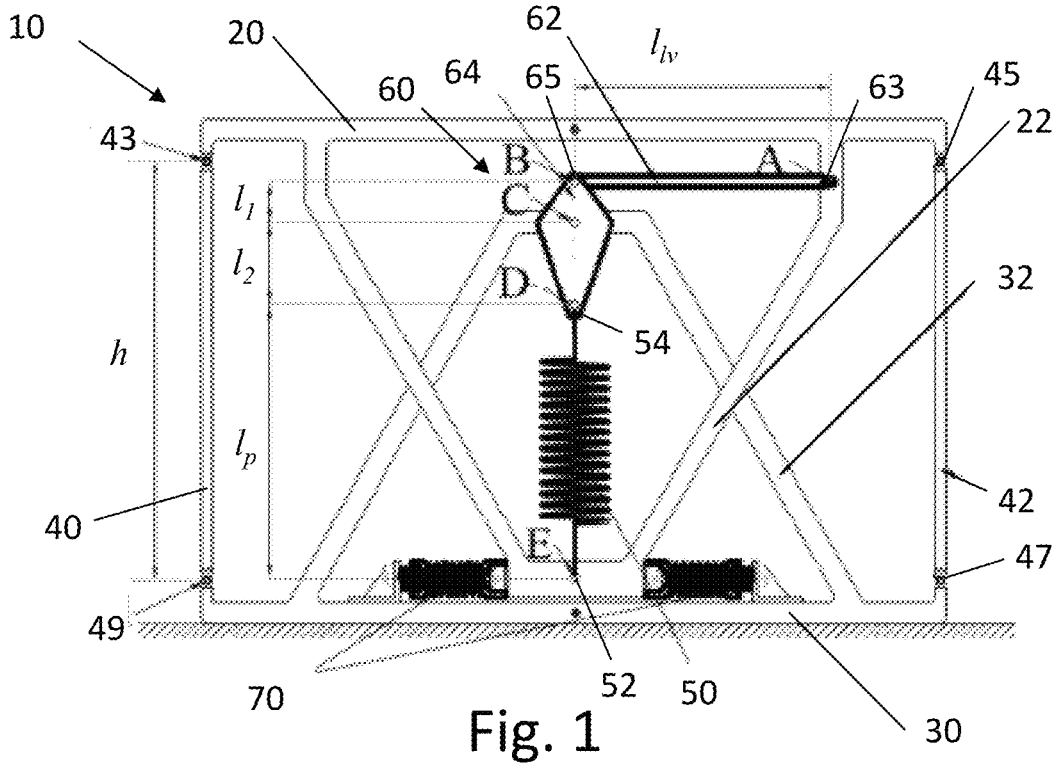
FIG. 1 is a diagram of a negative stiffness device in a rest state according to an embodiment of the present invention.
Figure 2:
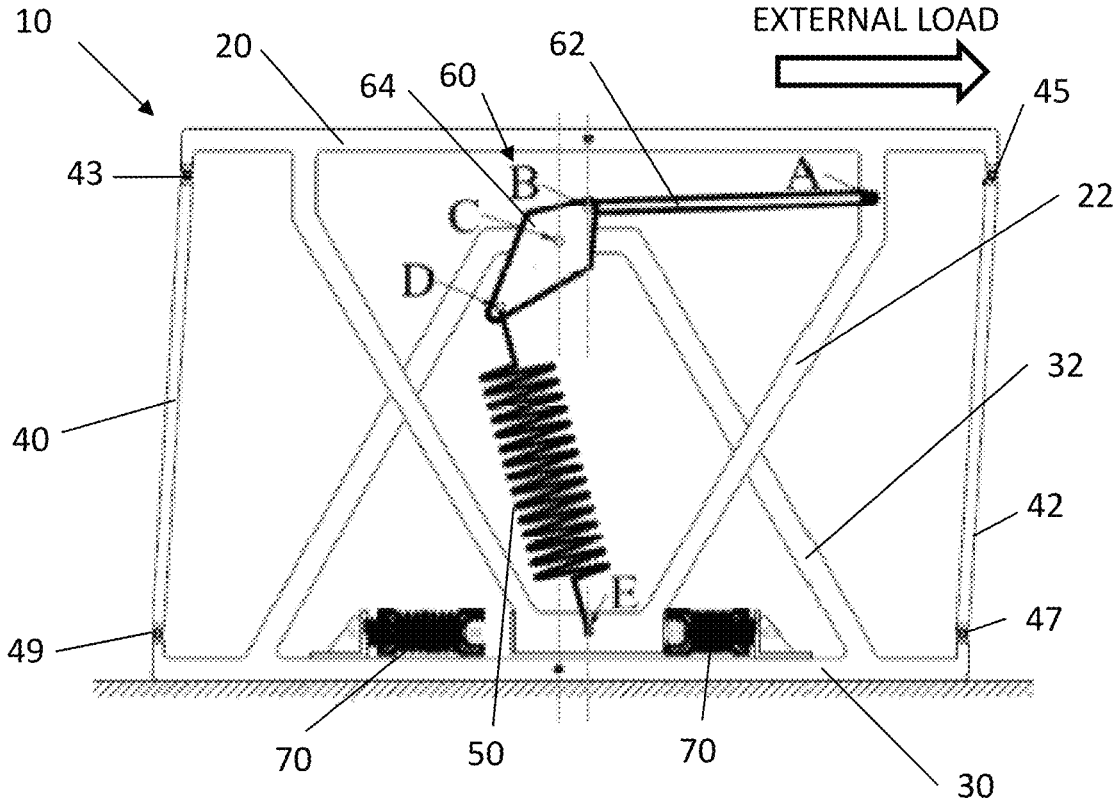
FIG. 2 is a diagram of the negative stiffness device of FIG. 1 in an engaged state.

A schematic of a device 10 according to an embodiment of the present invention is shown in FIG. 1, in a rest state, and shown in FIG. 2, in an engaged state. As shown in FIGS. 1 and 2, the device 10 includes a movement frame 20 and an anchor frame 30. The movement frame 20 has an extension portion 22, which extends in the direction of the anchor frame 30. The anchor frame 30 has an extension portion 32, which extends in the direction of the movement frame 20. In the embodiment shown in FIGS. 1 and 2, the extension portions 22, 32 are chevron braces, but other brace configurations could alternatively be used. Connecting members 40, 42 pivotably connect the anchor frame 30 to the movement frame 20, for example, via hinges 43, 45, 47, 49, such that movement frame 20 is laterally translatable relative to the anchor frame 30. The connecting members 40, 42 can limit the maximum vertical distance h between the movement frame 20 and the anchor frame 30. The embodiment shown in FIGS. 1 and 2, demonstrates how the device 10 may be modular (e.g., installed into a structure as a self-contained system). However, it is also within the scope of the present disclosure to configure a structure, itself, to have the features of the present invention.

A spring 50 may be in a compressed state and attached at a first end 52 to the extension portion 22 of the movement frame 20 and attached at a second end 54 to a linkage 60. The compressed spring 50 may be a pre-loaded machine spring, such as those marketed by Taylor Devices, Inc., where the spring is machined from a solid block of steel having rectangular coil or tangential beam spring elements, but other springs known in the art may be used, including metallic springs of coiled wire, stacked Belleville washers, single and multiple leaf springs, or pressurized gas springs or compressible fluid springs. Additionally, the compressed spring 50 can comprise a plurality of individual compressed springs.

The linkage 60 can comprise a lever member 62 and a pivot member 64. The lever member 62 can be pivotably connected to the extension portion 22 of the movement frame 20 at a first end 63 and pivotably connected to the pivot member 64 at a second end 65. The pivot member 64 can be pivotably connected to the extension portion 32 of the anchor frame 30.

In the engaged state, shown in FIG. 2, the movement frame 20 is translated relative to the anchor frame 30, thereby causing the linkage 60 to transfer the spring force created by the compression of the spring 50 and impart a lateral force to the movement frame 20 and urging further displacement. In FIG. 2, the location (A) at which lever member 62 is affixed to the extension portion 22 of the movement frame 22, is displaced in the right lateral direction relative to its initial position in the rest state. The lever member 62 is displaced, which causes pivot member 64 to rotate about its pivotable connection with extension portion 32 of anchor member 30 (at point C). Due to the axial rigidity of the lever and its negligible rigid body rotation, the imposed displacement at point A and the displacement of point B (where lever member 62 is connected to pivot member 64) are equal or substantially equal. Point D, where compressed spring 50 and pivot member 64 are attached, moves in the lateral direction opposite to that of point A. Point E, where compressed spring 50 is pivotably attached to extension member 22, is rigidly connected to the movement frame 20, and therefore has a displacement equal to that of point A. Due to the kinematics of points D and E, the compressed spring 50 rotates and its spring force urges further displacement of the movement frame rather than opposing it. Point D moves in an opposite lateral direction from that of an external load (e.g. seismic). The motion of point D relative to point E is magnified by comparison to the motion of point A: (a) by leverage produced by lever member 62 and pivot member 64, particularly the ratio of the distance DC ($l_1$) to CB ($l_2$); and (b) by the addition of lateral movement of point E by the same amount of lateral movement as point A. In some configurations, the lateral force can be about 20 to 100 times larger than the spring force at peak amplification. In the embodiment shown in FIGS. 1 and 2, the compressed spring 50 is at its minimum length (lp) when the device is in its rest state (FIG. 1). In the engaged state, the device 10 deforms from the rest state, the compressed spring 50 extends, its pre-compression force reduces, its angle of inclination increases, and as the displacement of the movement frame 20 occurs, the negative stiffness magnitude generated by the device 10 reduces.

A gap spring assembly 70 can be used to delay engagement of the compressed spring 50 until the displacement of the movement frame 20 exceeds a predetermined magnitude. For example, the gap spring assembly 70 can include a pair of opposing springs, each opposing spring being laterally disposed between the extension portion 22 of the movement frame and the anchor frame 30. The gap spring assembly 70 can provide a positive stiffness up to a predetermined displacement, such that the combined effective stiffness of the compressed spring 50 and the gap spring assembly 70 is zero or almost zero until the predetermined displacement of movement frame 20 is reached. The gap spring assembly 70 can be used to simulate bi-linear elastic behavior with an apparent-yield displacement that is smaller than the actual yield displacement of a structure that the device 10 is attached to. In this manner, the device 10 can avoid an excessive response for a relatively small external load (e.g., small seismic load, load caused by wind, etc.)

In use, the negative stiffness device 10 may be attached to a structure having large weight, such as a multi-story building. The device 10 begins at a rest state (FIG. 1), and is placed in an engaged state when the movement frame 20 is displaced to a predetermined point. For example, the movement frame 20 may be displaced by an external excitation. Although the present description generally describes an external excitation as a seismic load, the present invention is not limited to this example. Additional examples of external excitations can include wind force, blast, and other forms of vibration. It should also be understood that describing external loads on, and movement of the movement frame is done for convenience—seismic loading may be represented by movement of the foundation of a structure to which the anchor frame is connected. The relevant motion is the relative motion between the movement frame 20 and anchor frame 30. It should be understood that the negative stiffness device 10 may be attached at any two levels of a structure of which one, but not necessarily, may be the foundation of the structure.

When the device 10 is in an engaged state, the compressed spring 50 provides negative stiffness control forces that can reduce the natural frequency of the structural system by reducing its apparent stiffness and strength. When the movement frame 20 is laterally displaced to an amplification point, the spring force of the compressed spring 50 is amplified by the linkage 60. In some embodiments, the spring force is amplified by any lateral displacement of the movement frame 20. In other embodiments, the amplification point occurs after a predetermined displacement, for example, if a gap spring assembly 70 is used. It should be noted that the amplification point does not have to be a single displacement point, but can also be a range of lateral displacement of the movement frame 20.

Figure 3A:
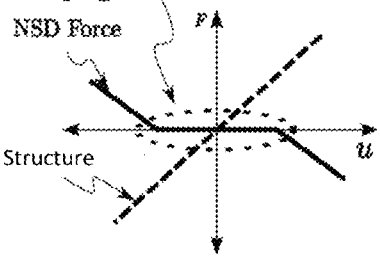
FIG. 3A is a force-displacement graph showing component forces of an exemplary system according to the present invention.
Figure 3B:
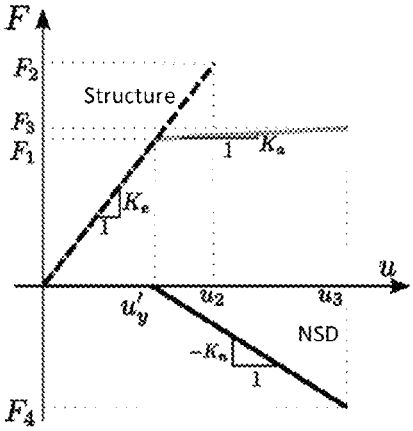
FIG. 3B is a force-displacement graph showing an assembly of the system of FIG. 3A without dampening.
Figure 3C:
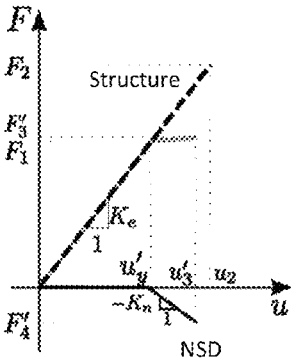
FIG. 3C is a force-displacement graph showing an assembly of the system of FIG. 3A with dampening.

FIG. 3A is a force-displacement graph that plots the component forces of an elastic spring representing a structure, a negative stiffness device added to the structure, and the damping force of a damper added to the structure. As shown in FIG. 3B, the negative stiffness device is activated at a prescribed apparent yield displacement $u_y'$. By introducing the negative stiffness $K_n$, the combined stiffness of the structure and the negative stiffness device reduces from an initial value $K_e$, at displacements from 0 to $u_y'$, and to $K_e$-$k_n$ beyond the displacement $u_y'$ (FIG. 3B). If, $F_2$ and $u_2$ are the maximum force and maximum displacement, respectively, of a structure without the negative stiffness device, then the maximum force and maximum displacement, respectively, of the structure with the negative stiffness device are $F_3$ and $u_3$, respectively, where force $F_3$ is much less than force $F_2$ (FIG. 3B). The value of negative stiffness $K_n$ can be therefore selected to achieve the desired reduction in base shear force F. However, the maximum deformation of the structure and the assembly is expected to increase as a result of reduction of the stiffness of the assembly. FIG. 3C shows the effect of adding dampers to the assembly, which results in reduction of displacement from value $u_3$ in FIG. 3B to the much smaller value $u_3'$ in FIG. 3C and, consequently, reduction in deformation to the structure and assembly. An example of a suitable damper for the present invention is a passive viscous damper with a 20 percent damping ratio, such as those commercially marketed by Taylor Devices, Inc. as self-contained Fluid Viscous Dampers for Seismic and Wind load Protection of Structures, commonly used in force capacities ranging from 50,000 lbs to 2,000,000 lbs output force.

Figure 4A:
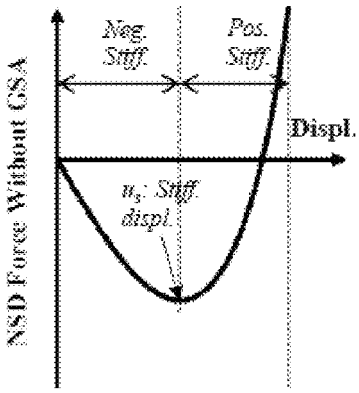
FIG. 4A is a force-displacement graph of an exemplary negative stiffness device without a gap spring assembly in accordance with the present invention.
Figure 4B:
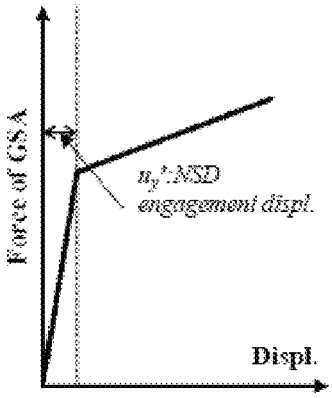
FIG. 4B is a force-displacement graph of an exemplary gap spring assembly in accordance with the present invention.
Figure 4C:
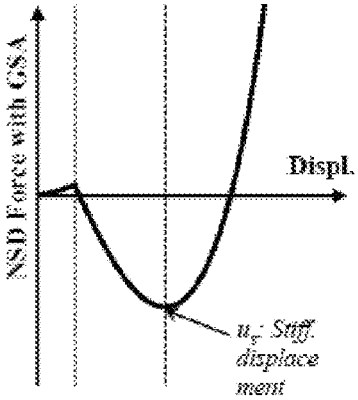
FIG. 4C is a force-displacement graph of an exemplary negative stiffness device with a gap spring assembly in accordance with the present invention.

FIG. 4A is a force-displacement graph of an exemplary negative stiffness device without a gap spring assembly in accordance with the present invention. FIG. 4B is a force-displacement graph of an exemplary gap spring assembly in accordance with the present invention. The addition of the gap spring assembly of FIG. 4B to the negative stiffness device of FIG. 4A results in the relation shown in FIG. 4C. In the resulting combined system, net stiffness is approximately at zero or just above zero until the apparent-yield displacement point $u_y'$ is reached (the displacement beyond which the negative stiffness device is engaged). That is, the gap spring assembly can be designed to generate a positive stiffness equal to, or slightly larger than the negative stiffness, when there is zero displacement so that the overall stiffness generated by the device for displacements less than $u_y'$ is approximately zero or slightly larger than zero as shown in FIG. 4C. It should be noted that the vertical component of the spring force provided by the compressed spring 50 substantially offset by a counter-directional force provided by the connecting members 40, 42 (ignoring any slight vertical displacement of the movement frame 20 caused by the connecting members). In this manner, when the device 10 is attached to a structure, it does not impose a vertical load on the structure. It is contemplated, however, that the present invention could be configured, if desired, to impart some degree of vertical load to a structure.

FIG. 4A also shows that the negative stiffness force produced by the device 10 initially increases as displacement occurs. The negative stiffness of the device 10 then decreases until device 10 produces a positive stiffness when the spring 50 is stretched beyond a null point $u_5$ at larger displacements. This "stiffening" effect can be desirable. For example, the device 10 can act as a displacement restrainer in the event of seismic load that is beyond a predetermined maximum, thus preventing excessive displacement and collapse of the structure.

Figure 5B:
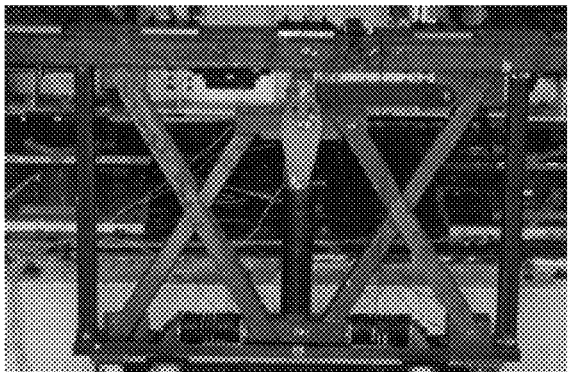
FIG. 5B shows the device shown in FIG. 5A in an engaged state.
Figure 5B:
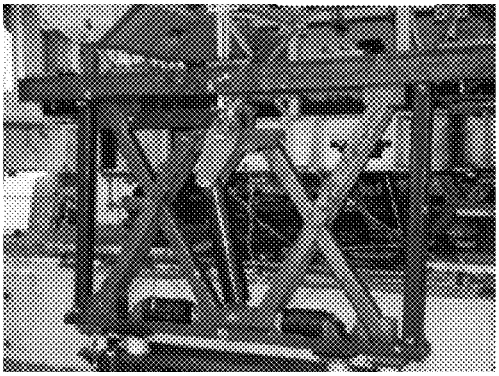
Figure 6A:
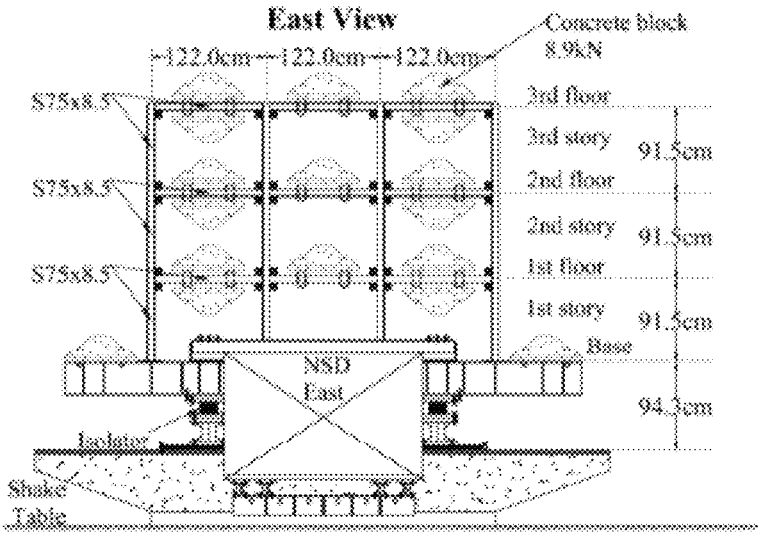
FIG. 6A is an elevational view of negative stiffness devices attached to a structure in accordance with an embodiment of the present invention.
Figure 6B:
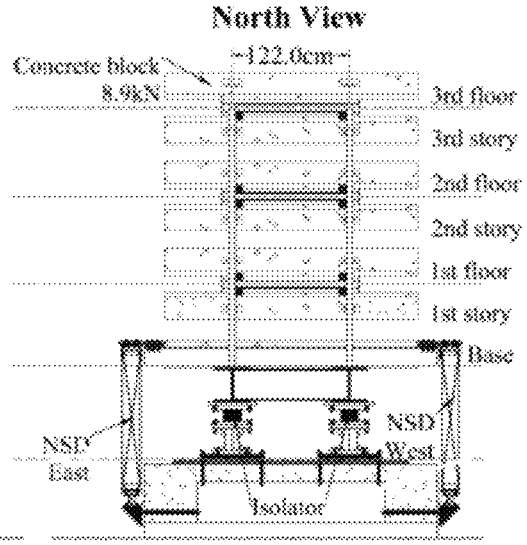
FIG. 6B is a side view of the negative stiffness devices and structure of FIG. 6A.

FIGS. 5A and 5B are photographs of a prototype of an exemplary negative stiffness device 90 built according to an embodiment of the present invention in a rest state (FIG. 5A) and an engaged state (FIG. 5B). The device 90 was installed on a model structure and tested at the University at Buffalo with a shake table, which simulates shaking ground during an earthquake. As shown in FIGS. 6A and 6B, two negative stiffness devices 10 were attached to a three story structure that is supported by an elastomeric isolation system. Tests were conducted with and without added viscous dampers in the isolation system. The model structure was subjected to simulated earthquakes, shown in Table 1 (below). The simulated earthquakes were modeled after historical earthquake motions recorded in the United States and abroad.

TABLE 1

Earthquake Motions Used in Testing

| Earthquake/Year | Notation | Magnitude | Peak Ground Acceleration (g) |
|---|---|---|---|
| San Fernando, California, 1971 | PUL-254 | 6.6 | 1.16 |
| Northridge, California, 1994 | NWH-090 | 6.7 | 0.70 |
| Northridge, California, 1994 | 637-270 | 6.7 | 0.80 |
| Kobe, Japan, 1995 | KJM-090 | 6.9 | 0.71 |
| Chi-Chi, Taiwan, 1999 | TCU-129-E | 7.6 | 0.79 |
| Loma Prieta, California, 1989 | CAP-000 | 6.9 | 0.48 |
| Denali, Alaska, 2002 | PS-10317 | 7.9 | 0.32 |
| Kocaeli, Turkey, 1999 | DZC-270 | 7.5 | 0.33 |

Figure 7A:
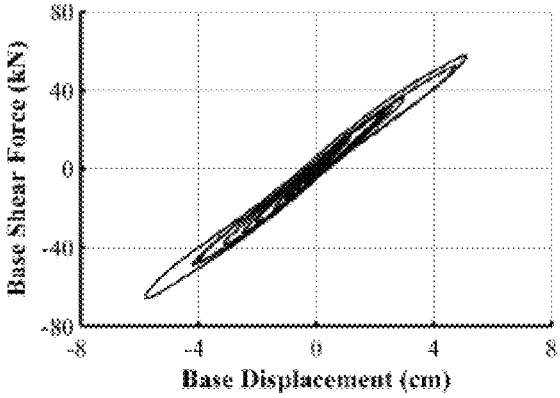
FIG. 7A is a force-displacement graph showing recorded force-displacement loops of an exemplary isolation system without a negative stiffness device.
Figure 7B:
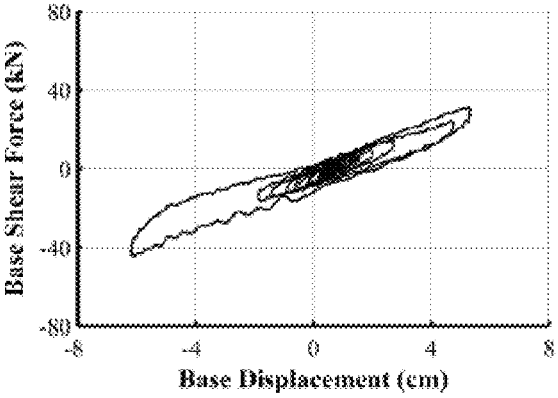
FIG. 7B is a force-displacement graph showing recorded force-displacement loops of an exemplary isolation system with a negative stiffness device in accordance to an embodiment of the present invention.

FIGS. 7A and 7B are graphs showing recorded force-displacement loops of the isolation system without (FIG. 7A) and with (FIG. 7B) the negative stiffness devices 90. It can be seen that the reduction in stiffness by the addition of the tested negative stiffness devices 90 is significant.

Figure 8:
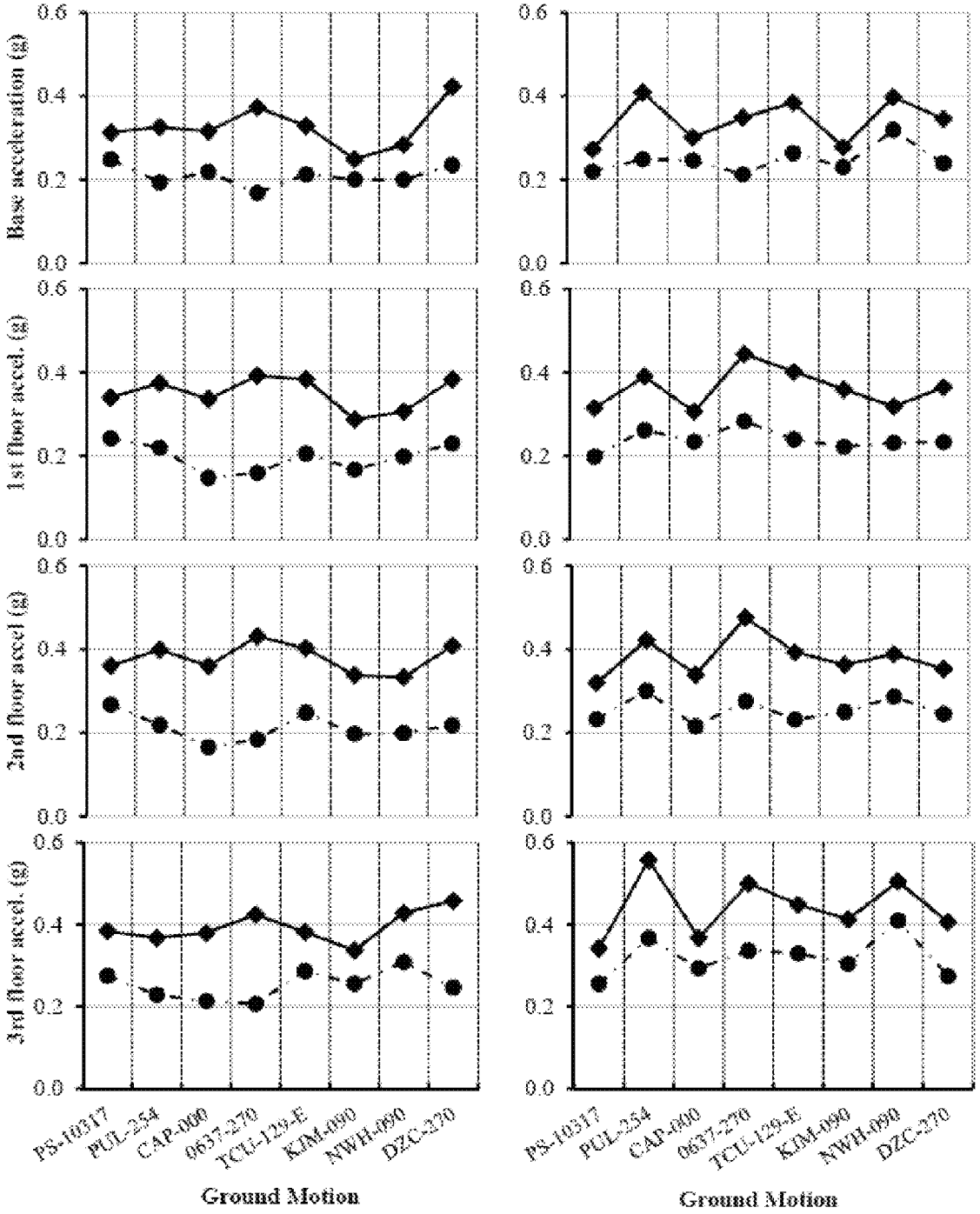
FIG. 8 shows graphs of peak acceleration of respective platforms of a model structure tested with (dashed line) and without an exemplary negative stiffness device (solid line) in two different configurations.
Figure 9:
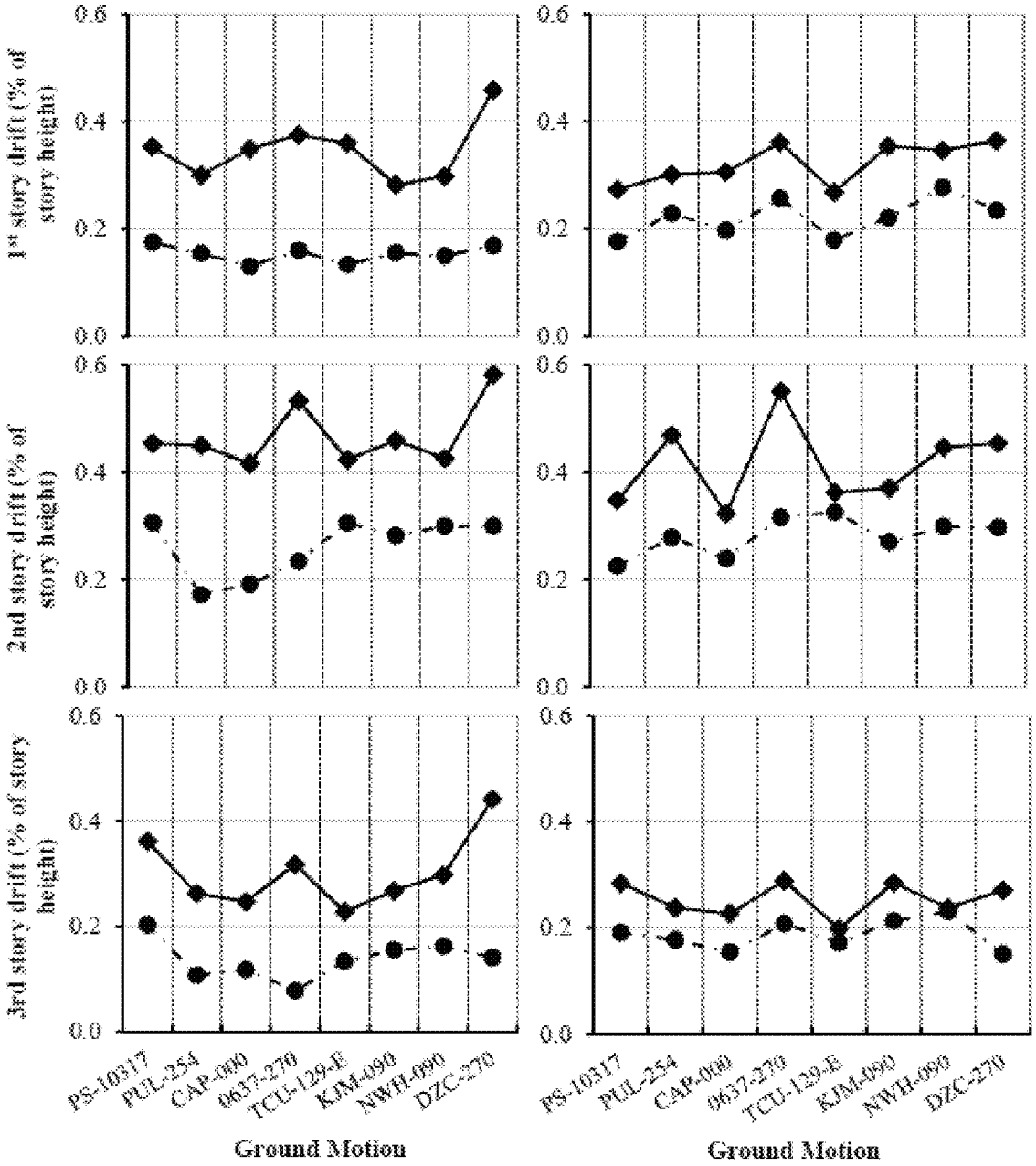
FIG. 9 shows graphs of peak inter-story drift or relative displacement for each of a model structure's stories tested with and without an exemplary negative stiffness device in two different configurations.
Figure 10:
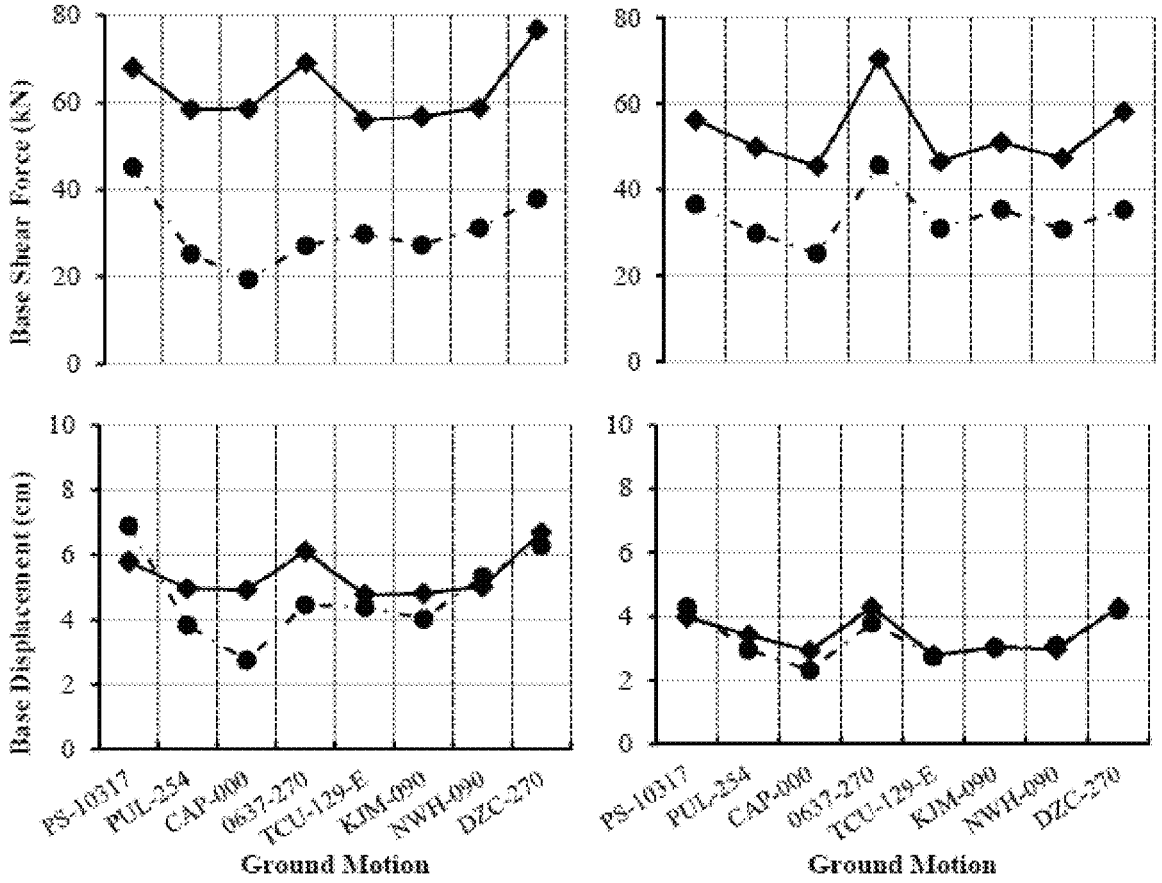
FIG. 10 shows graphs of peak shear force transmitted between the model ground (shake table) and graphs of peak displacement of the model structure tested with and without an exemplary negative stiffness device in two different configurations.

FIGS. 8, 9, and 10 are graphs showing the recorded peak response of the tested model structure. In each of these figures, the solid line represents the response of the model system without the negative stiffness devices 90 and the dashed line represents the response of the model system with the negative stiffness devices 90 installed. In FIGS. 8, 9, and 10, the left column of graphs depict the test results for the model system without viscous dampers, and the right column of graphs depict the test results for the model system with viscous dampers.

FIG. 8 graphs the peak acceleration of each platform (base and floors 1, 2 and 3) of the model structure. The peak accelerations are a measure of the inertial forces acting on the model structure and are responsible for damage to non-structural components such as suspended ceilings, sprinkler systems, anchored equipment, etc. A reduction of the peak acceleration at all levels is desirable.

FIG. 9 graphs the peak inter-story drift or relative displacement for each of the model structure's stories (stories 1, 2, and 3). The drift represents a measure of damage to the structural system (columns, braces, etc.) and to non-structural systems spanning between two floors such as walls, partitions, vertical pipes, etc. It is desirable to reduce the drift for all stories.

FIG. 10 graphs the peak shear force transmitted between the ground (shake table) and the model structure above. This force is the sum of all inertia forces acting on the structure and is the force for the design of the foundation. It is desirable to reduce the base shear force.

As shown in FIGS. 8, 9, and 10, the addition of the negative stiffness devices 90 resulted in substantial reduction of acceleration, inter-story drift, and base shear force, whereas the base displacement is slightly reduce or is unaffected. The addition of dampers had a marked effect on reducing the base displacement and worked synergistically with the devices 90.

Figure 11A:
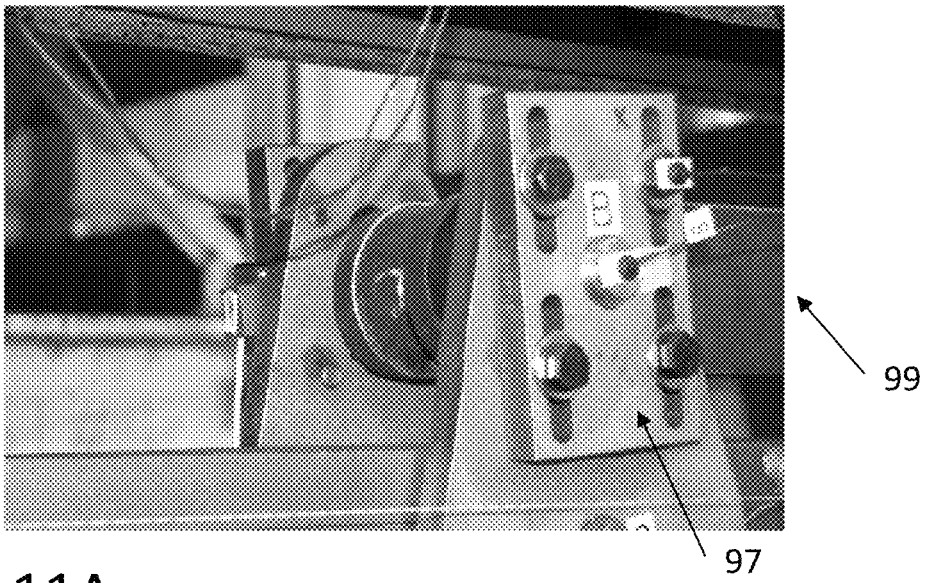
FIG. 11A shows an exemplary adjustable pivot member of a negative stiffness device in accordance to an embodiment of the present invention.
Figure 11B:
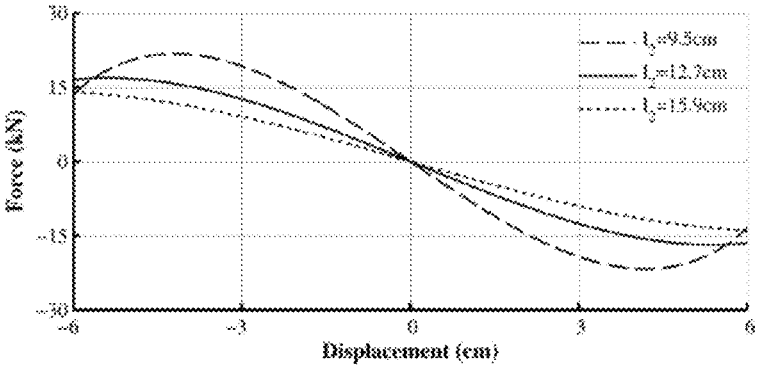
FIG. 11B is a force-displacement graph showing the effect of adjusting the adjustable pivot member shown in FIG. 11A.

In other embodiments of the present invention, the negative stiffness device 95 may be adjustable in the field. For example, FIG. 11A shows an adjustable pivot member 97 that can be adjusted to obtain a particular lever ratio, and therefore, different negative stiffness device force-displacement relations. FIG. 11B shows three force-displacement graphs showing the effect of adjusting the distance $l_2$ between the pivot point C of the pivot member 97 and the point in which the pivot member 97 and lever member 99 meet (see FIG. 1).

Figure 12A:
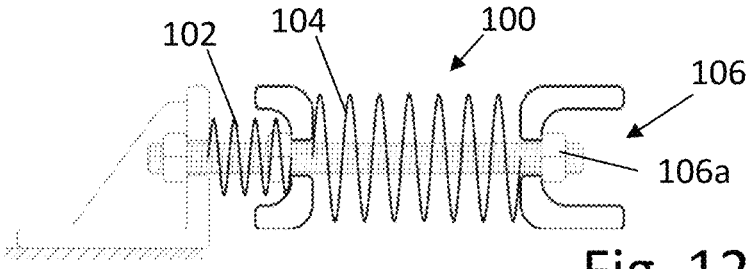
FIGS. 12A and 12B are diagrams of exemplary gap spring assemblies for use with negative stiffness devices according to embodiments of the present invention.
Figure 12B:
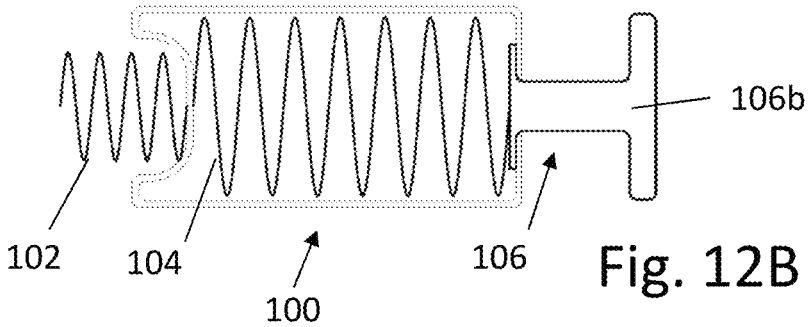

The present invention may also be equipped with an adjustable gap spring assembly. FIGS. 12A and 12B show embodiments where a gap spring assembly 100 has a first spring 102, a second spring 104, and an adjuster 106 that changes the predetermined lateral displacement of the gap spring assembly 100. Second spring 104 may be compressed to have a preload. In the embodiment shown in FIG. 12A, the preload of the second spring 104 is adjusted by tightening nut 106*a*. FIG. 12B shows a second embodiment of the gap spring assembly where a piston 102*b* is used to adjust the second spring 104. The piston can be provided, for example, with a threaded portion to adjust the preload of the second spring 104.

In another embodiment, the present invention is embodied as a method of protecting a structure from seismic activity. The method can include steps of providing at least one negative stiffness device. The negative stiffness device can include an anchor frame and a movement frame. The movement frame may be laterally translatable relative to the anchor frame. The anchor frame may have an extension portion extending in the direction of the movement frame. The movement frame may have an extension portion extending in the direction of the anchor frame. A linkage can be pivotably connected to the extension portion of the anchor frame. A compressed spring can have a first end attached to the extension portion of the movement frame and a second end attached to the linkage. The compressed spring is provided with a spring force. The at least one negative stiffness device can be configured to have a rest state where the compressed spring does not displace the movement frame and an engaged state where the compressed spring applies a lateral force to the movement frame such that the movement frame is displaced in a lateral direction of a seismic load. The linkage can be configured to amplify the spring force when the movement frame is laterally displaced to an amplification point. The at least one negative stiffness device can be installed at the base of a multi-story structure, by, for example, attaching the anchor frame to the floor and attaching the movement frame to the ceiling. In other embodiments a second of the at least one negative stiffness device is installed in a second story of the multi-story structure.

In a further embodiment, the compressed spring rotates about the first end of the compressed spring in the engaged state, such that the second end of the compressed spring may be displaced in an opposite lateral direction to the lateral direction of the seismic load. The linkage can include a pivot member and a lever member, the pivot member having a first end, a pivot point, and a second end, the lever member having a first end and a second end. The first end of the lever member can be pivotably attached to the extension portion of the movement frame and the second end of the lever member pivotably attached to the first end of the pivot member. The pivot point of the pivot member may be pivotably attached to the extension member of the anchor member and the second end of the pivot member may be pivotably attached to the compressed spring. The first end of the pivot member can be closer to the pivot point than the second end of the pivot member. Additionally, in the engaged stated, the first end of the lever member may be displaced by a first lateral distance, and the second end of the compressed spring may be displaced by a second lateral distance. The first lateral distance and the second lateral distance can be substantially equal.

The present disclosure can also be embodied as a "brace" system, having a similar principle of operation as the previous embodiments of negative stiffness devices described herein. More particularly, the exemplary brace systems described herein can include a "compressed" spring that introduces negative stiffness to cooperate with motion, for example, motion caused by seismic activity, rather than to oppose such motion. The exemplary brace systems depicted in FIGS. 13-16 can be particularly useful for a compact arrangement of a device that employs the principles of negative stiffness described herein. Furthermore, a brace system can advantageously be configured to employ magnification mechanisms at both ends of a spring. This can, for example, increase a spring's inclination angle and take advantage of the spring force at both ends of the spring.

FIGS. 13A-13B depict an exemplary negative stiffness brace system 200, 200'. More particularly, FIG. 13A shows the system 200 in a rest or un-deformed position. FIG. 13B shows the system 200' in an engaged or deformed position. The displacement between the rest system 200 and engaged system 200' in FIGS. 13A-13B is represented by u. The system 200, 200' includes an anchor frame 210 and a movement frame 220, a first linkage 230, a second linkage 240, and a compressed spring 250. The first linkage 230 and the second linkage 240 can be pivotably connected to the anchor frame 210 at pivot points $P_1$ and $P_2$, respectively. The spring 250 can be pivotably connected to the linkages 230, 240 at pivot points $P_3$ and $P_4$, respectively. The length between each of the pivot points $P_1$ and $P_2$ and respective pivot points $P_3$ and $P_4$ is represented by $l_1$. The length between each of the pivot points $P_1$ and $P_2$ and the movement frame is represented by $l_2$. Length $l_1$ can be greater than length $l_2$ to achieve a desired magnification of spring force applied to the movement frame 220. Consequently, a system with a higher magnification (e.g. a system having a higher ratio of $l_1$ to $l_2$) can achieve the same force with less displacement than a system with lower magnification.

In operation, the system 200 can begin in a rest state, shown in FIG. 13A, where spring 250 is in a compressed state. Although spring 250 applies a force to the anchor frame 210 at pivot points $P_1$ and $P_2$, the spring 250 can be configured to not apply sufficient force to displace the movement frame 220 relative to the anchor frame 210. The system 200' can be placed in its engaged state, for example, by displacement of the movement frame 220 relative to the anchor frame 210. The displacement of the movement frame 220 may be caused by a seismic force. Once displacement of the movement frame 220 occurs relative to the anchor frame 210, the linkages 230, 240 can rotate (e.g. clockwise). Upon rotation of the linkages 230, 240, spring 250 will also rotate (e.g. clockwise) and decompress. In this manner, the spring force of spring 250 is applied through the linkages 230, 240 to displace the movement frame 220. The linkages 230, 240 can amplify the spring force as the system 200, 200' moves from its rest state (FIG. 13A) to its engage state (FIG. 13B).

For "small" deformations, such as a deformation of about 1% of the total available deflection of a system 200, 200', the force-displacement relationship of the system 200, 200' can be expressed by:

$$F_{Brace} = -2P_{in}\frac{l_1}{l_2}\left(\frac{2}{l_p}\frac{l_1}{l_2} + \frac{1}{l_2}\right)u$$

where $P_{in}$ is the preload force of spring 250. The quantity $F_{Brace}/u$ in this equation expresses a stiffness value that is negative. Consequently, the force of the system 200, 200' can be in the direction of the displacement u rather than opposing the displacement u. So called "positive stiffening" can be delayed using a spring 250 have a smaller spring constant.

FIG. 14 shows another system 300 according to the present disclosure. More particularly, system 300 includes an anchor frame 310 and a movement frame 320, a first linkage 330, a lever 340, and a compressed spring 350. This system 300 is similar to the system 200, except that spring 350 is pivotably attached to the anchor frame 310. Consequently, the single linkage 330 and lever 340 produce "one-sided" magnification, as opposed to the "two-sided" magnification system 200

(produced from linkages 230, 240). As will be understood, the force-displacement relation for the system 300, for "small" deformations, such as a deformation of about 1% of the total available deflection of the system 300, can be expressed by:

$$F_{onesided} = -P_{in}\frac{l_1}{l_2}\left(\frac{1}{l_2} + \frac{l_1}{l_2}\frac{1}{l_p}\right)u$$

Figure 15:
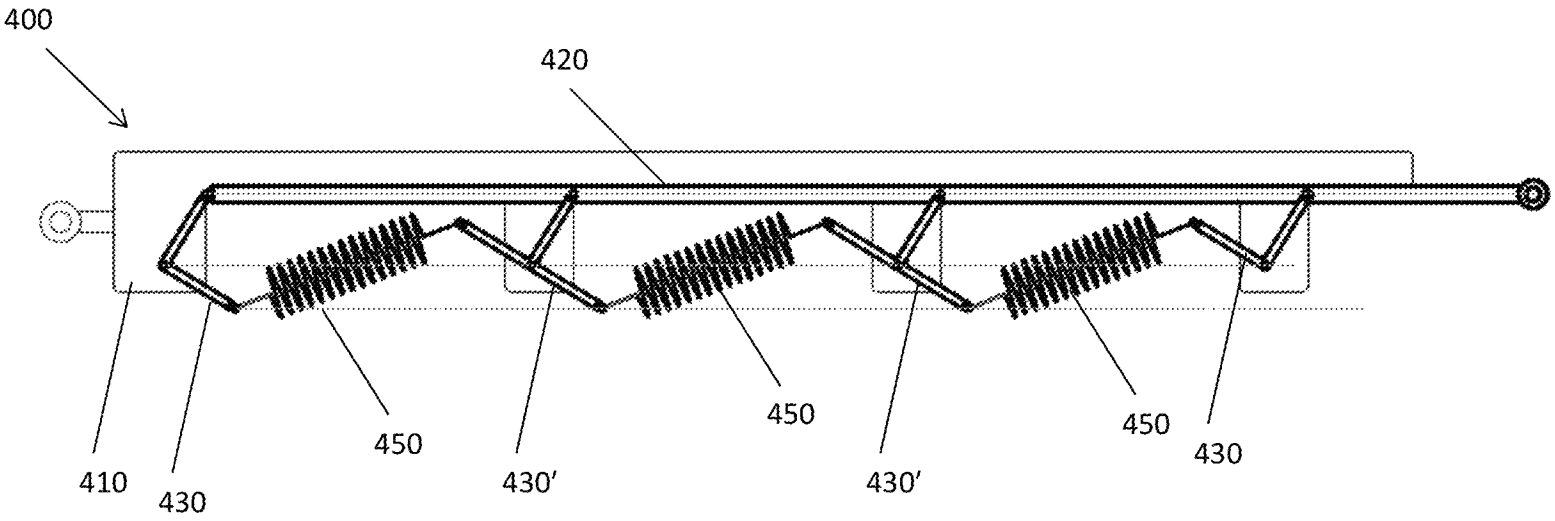
FIG. 15 is a diagram of a third embodiment of a negative stiffness brace system.

FIG. 15 shows another system 400 according to the present disclosure that has a similar to the arrangement of FIG. 13, however system 400 includes a plurality of springs 450 arranged in "series." More particularly, system 400 includes an anchor frame 410 and a movement frame 420, and a plurality of linkages 430, 430', and a plurality of springs 450. The linkages 430 may be attached to a single spring, while the linkages 430' can be attached to more than one spring 450. The force-displacement for the system in FIG. 15 can be expressed by:

$$F_{Brace} = -2n_sP_{in}\frac{l_1}{l_2}\left(\frac{2}{l_p}\frac{l_1}{l_2} + \frac{1}{l_2}\right)u$$

where $n_s$ is the number of springs in the system 400, presumed here to be identical in properties, and have the same preload and dimensions. It should be noted that the force-displacement relationship for system 400 is substantially similar to the force-displacement relationship of system 200, but is multiplied by the number of springs, $n_s$. This demonstrates the modularity of this embodiment. For example, identical preloaded springs-magnification mechanisms can be added to this system 400 to increase negative stiffness as additional springs 450 are added in series.

Table 2 provides a comparison of the embodiments shown in FIG. 1, 13A, 14, and a hypothetical negative stiffness device without magnification (not shown). Specifically, Table 2 expresses the force as a function of pre-load for each of these embodiments, assuming "small" deformations, such as a deformation of about 1% of the total available deflection of each system. The comparison assumes that each embodiment has a single, preloaded spring of the same constant and preload. The hypothetical negative stiffness device without magnification has a force-displacement relationship that is expressed by:

$$F_{simple} = -(P_{in}/l_p)u$$

TABLE 2

| Force (as a function of pre-load $P_{in}$ and displacement u) | | | | |
|---|---|---|---|---|
| Length Ratio | NSB (FIG. 13A) | NSD (FIG. 1) | NSB with One-Sided Magnification (FIG. 14) | NSD without Magnification |
| $l_1/l_2 = 1$ | $-\frac{16}{30}P_{in}u$ | $-\frac{10}{30}P_{in}u$ | $-\frac{7}{30}P_{in}u$ | $-\frac{1}{30}P_{in}u$ |
| $l_1/l_2 = 2$ | $-\frac{40}{30}P_{in}u$ | $-\frac{24}{30}P_{in}u$ | $-\frac{16}{30}P_{in}u$ | $-\frac{1}{30}P_{in}u$ |
| $l_1/l_2 = 3$ | $-\frac{72}{30}P_{in}u$ | $-\frac{42}{30}P_{in}u$ | $-\frac{27}{30}P_{in}u$ | $-\frac{1}{30}P_{in}u$ |

*For the calculations, lengths $l_p = 30$ in and $l_2 = 5$ in were used.

Table 2 shows that significantly more force can be generated in the direction of displacement with a negatives stiffness brace system, as compared to other embodiments. Furthermore, as noted above, a negative stiffness brace system according to the present disclosure can be configured to produce even larger negative stiffness by incorporating additional preloaded springs.

A brace system (such as systems 200, 300, and 400) can also include a gap spring assembly (GSA) device that has a bilinear force-displacement relation (positive stiffness). The GSA can be added in series to a brace system such that negative stiffness can be introduced after a pre-determined displacement is reached. A system having a GSA can avoid engagement of a brace system for displacements below the pre-determined limit. This can allow a brace system according to the present disclosure to reduce the stiffness of a structure for strong seismic loadings, but not reduce stiffness due to relatively minor loadings, such as loadings due to service, wind, or weaker seismic loadings. The GSA can be installed within a guide cylinder, and include a piston and end rods. When the brace is subjected to compression, the force-displacement relation of the GSA can be bilinear elastic. When the GSA is subjected to tension, the force can be zero, or close to zero.

Figure 16A:
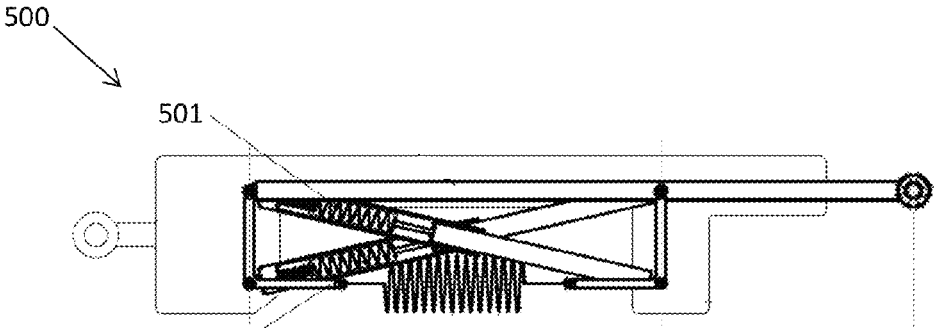
FIGS. 16A and 16B are diagrams of an exemplary negative stiffness brace system having a gap spring assembly.
Figure 16B:
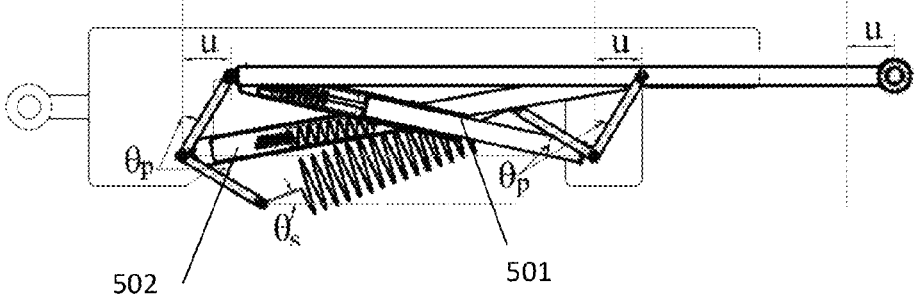

FIGS. 16A and 16B depict a brace system 500 having two GSA's 501, 502. Other than the addition of the GSA's, system 500 is the same as system 200. In this arrangement, the GSA's 501, 502 can create a bilinear force-displacement relation in both tension and compression. In FIG. 16B, where system 200' is in an engaged state, GSA 501 is in compression and GSA 502 is inactive. When the load applied to the system 500 reverses direction, GSA 502 would be in compression and GSA 501 would be inactive. The force displacement of brace system 500 can be expressed by:

$$F_{Brace} = -2n_s\frac{F_s}{l_s}\frac{l_1}{l_2}\left(\frac{2l_1}{l_2} + \frac{\sqrt{l_2^2l_s^2 - 4l_1^2u^2}}{l_2\sqrt{l_2^2 - u^2}}\right)u + \frac{n_{GSA}}{2}\cos(\theta_{GSA})F_g$$

Although the system 500 depicted in FIGS. 16A and 16B includes only one spring and two GSA's, the above equation accounts for the general case of $n_s$ springs installed in series and $n_{GSA}$ GSA's. The number of GSA's ($n_{GSA}$) is divided by two to account for the fact that, for each pair of GSA's, only one GSA is active during engagement of the system $\theta_{GSA}$ is the angle formed by the GSA and the horizontal in the deformed configuration given by the following equation:

$$\theta_{GSA} = \tan^{-1}\left[\frac{\sqrt{l_2^2 - u^2}}{2l_1 + l_p - u}\right]$$

$F_g$ is the GSA force given by the following equation:

$$F_g = \begin{cases} k_1u_d, & 0 \le u_d \le u_1 \\ P_1 + k_2(u_d - u_1) & u_d > u_1 \end{cases}$$

where $k_1$ is the initial stiffness of the GSA, $k_2$ is the secant stiffness of the GSA, and $P_1$ and $u_1$ are the force and displacement at which the stiffness transitions from $k_1$ to $k_2$. These properties are related to the properties of the spring of the GSA. Finally, $u_d$ is the deformation of the system 500 expressed by:

$$u_d = \sqrt{(2l_1+l_p)^2+l_2^2} - \sqrt{(2l_1+l_p-u)^2+l_2^2-u^2}$$

Figure 17:
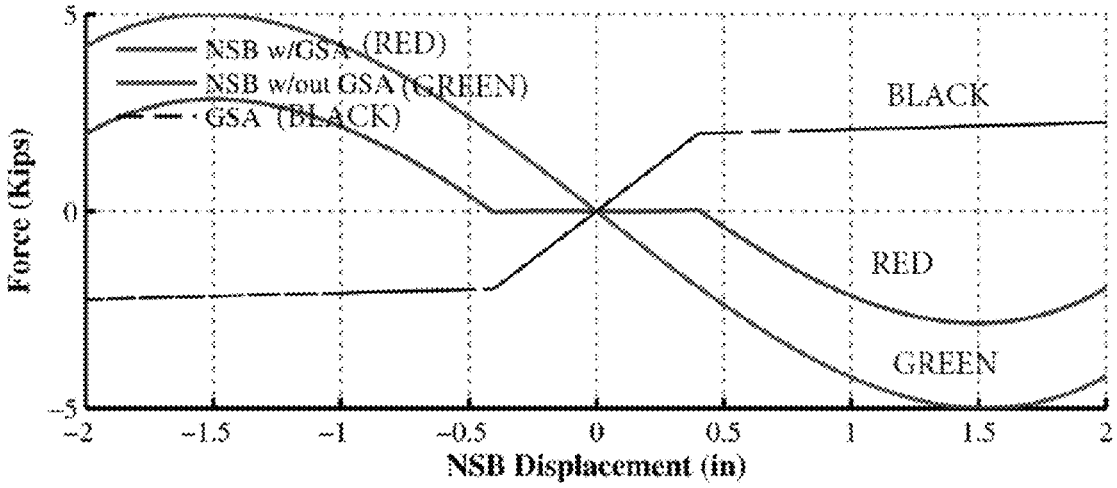
FIG. 17 shows graphs of force-displacement relationships for: a gap spring assembly; a brace system with a gap spring assembly; and a brace system without a gap spring assembly.

FIG. 17 plots force-displacement relationships for: (1) a GSA; (2) a brace system with a GSA; and (3) a brace system without a GSA according to the force-displacement relationship described above with respect to brace system 500. The plotted brace system assumes the parameters $n_s$=1 and $n_{GSA}$=2. The GSA force-displacement relation is plotted with the parameters $u_1$=0.4 in, $P_1$=1.97 kip, $k_1$=4.93 kip/in and $k_2$=0.16 kip/in.

Figure 18:
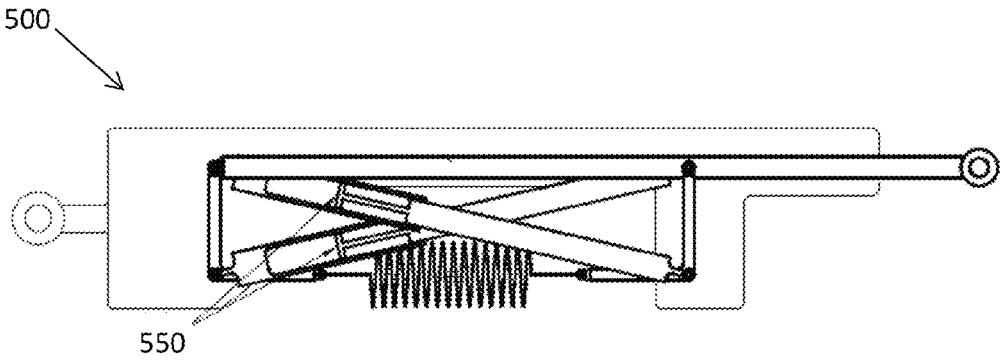
FIG. 18 is a diagram of an exemplary negative stiffness brace system having dampers.

A negative brace system according to the present disclosure may also include one or more dampers. FIG. 18 depicts one such arrangement, where dampers 550 are incorporated into the system 500. The force-displacement relation of a system having $n_s$ springs installed in series, $n_{GSA}$ GSA braces, and $n_{VD}$ linear viscous dampers are expressed by the following equation:

$$F_{Brace} = -2n_s\frac{F_s}{l_s}\frac{l_1}{l_2}\left(\frac{2l_1}{l_2} + \frac{\sqrt{l_2^2 l_s^2 - 4l_1^2u^2}}{l_2\sqrt{l_2^2 - u^2}}\right)u + \frac{n_{GSA}}{2}\cos(\theta_{GSA})F_g + n_{VD}\cos(\theta_{GSA})c\dot{u}_d$$

In this equation, $\theta_{GSA}$ is the angle formed by the dampers with respect to the horizontal axis of the system in the deformed configuration (assumed to be same as that of the GSA braces). The damping constant for a damping device in the system 500 is expressed by C. $\dot{u}_d$ is the deformation rate of the viscous dampers and is given by the derivative of $u_d$ with respect to time. $\dot{u}_d$ can be expressed by:

$$\dot{u}_d = \frac{(2l_1 + l_p - u) + u}{\sqrt{(2l_1 + l_p - u)^2 + l_2^2 - u^2}}\dot{u}$$

Figure 19:
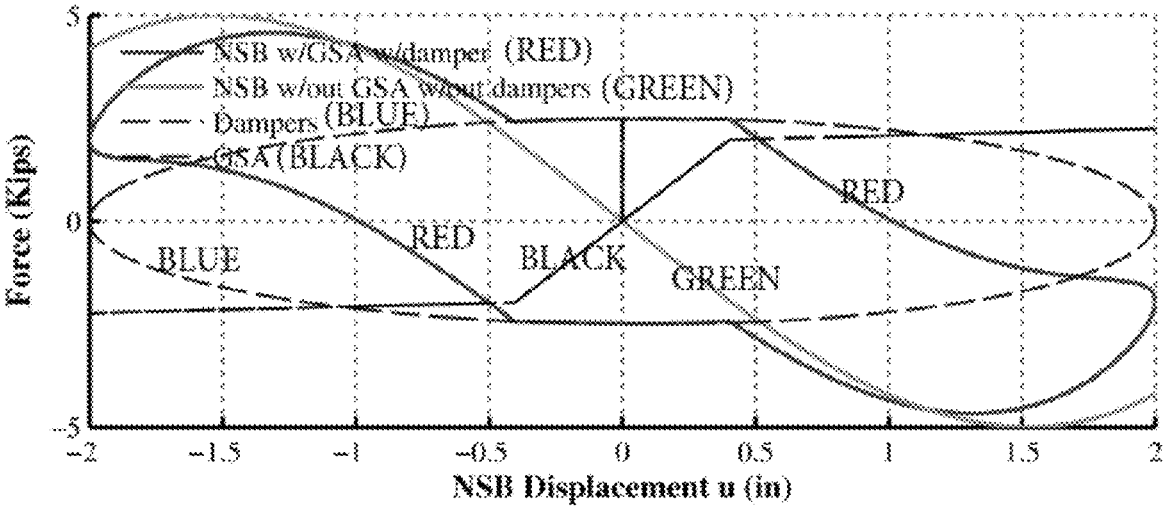
FIG. 19 shows graphs of force-displacement relationships for: a brace system with a gap spring assembly and damper; a brace system without a gap spring assembly and without a damper; a damper; and a gap spring assembly.

As can be seen, dampers in the exemplary system 500 can undergo the same deformation as the GSA of the system. FIG. 19 plots the force-displacement relationship of a brace system with a GSA and damper, a brace system without a GSA and without a damper, a damper, and a GSA.

Figure 20:
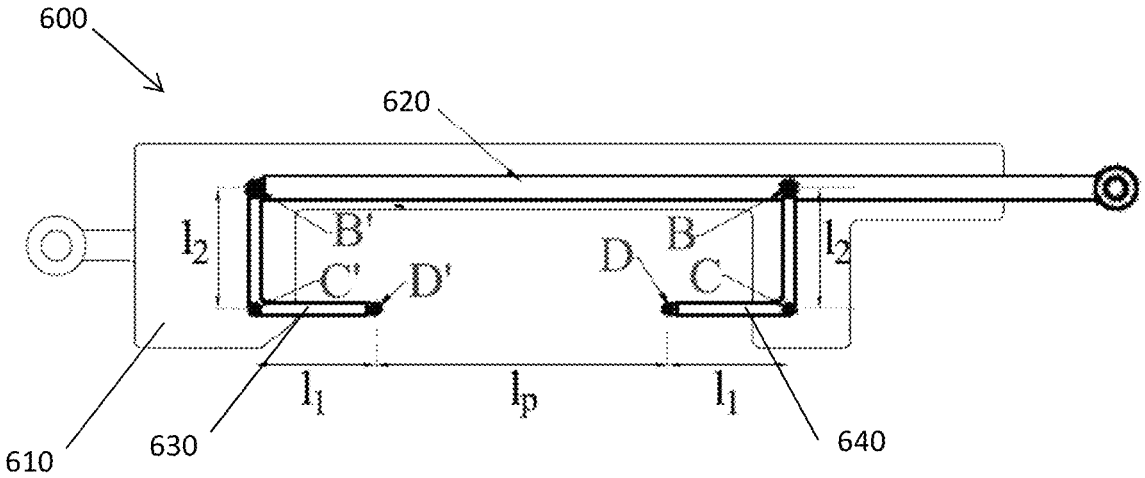
FIG. 20 is a diagram of an assembly that may be used with a negative stiffness brace system.

A brace system according to the present disclosure can have an assembly 600 as shown in FIG. 20. The assembly can include an anchor frame 610 and a movement frame 620, a first linkage 630, and a second linkage 640. The first linkage 630 and the second linkage 640 can be pivotably connected to the anchor frame 610 at pivot points C and C', respectively. Furthermore, the first linkage 630 and the second linkage 640 can be pivotably connected to the movement frame 620 at pivot points B and B', respectively. As noted with respect to the description of previous embodiments, a spring can be pivotably connected to first linkage 630 and the second linkage 640 at points D and D' to operate in a substantially similar manner as the brace systems described above. The following description describes features that can be added to assembly 600 such that the assembly 600 can exhibit a desired behavior. Although the following description discusses various features with respect to assembly 600, it should be noted that these features can be added to any of the embodiments described herein to achieve a similar, desired behavior.

Figure 21:
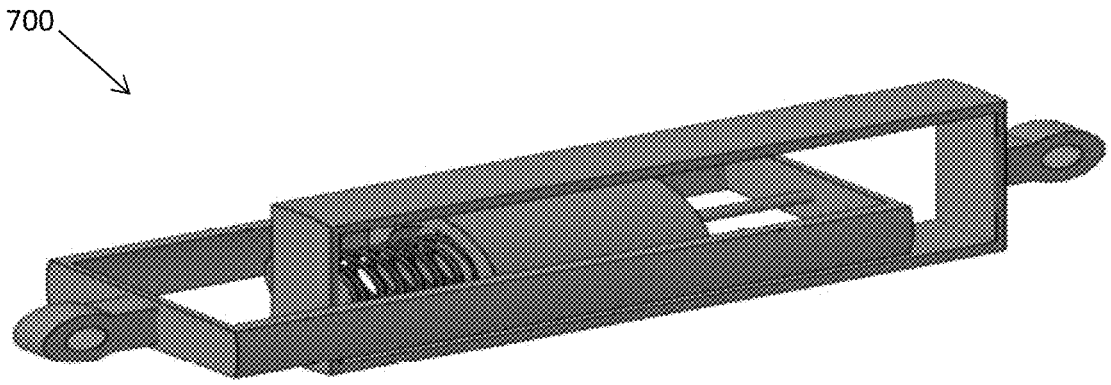
FIGS. 21-24 depict an exemplary tension-compression gap spring assembly.
Figure 22:
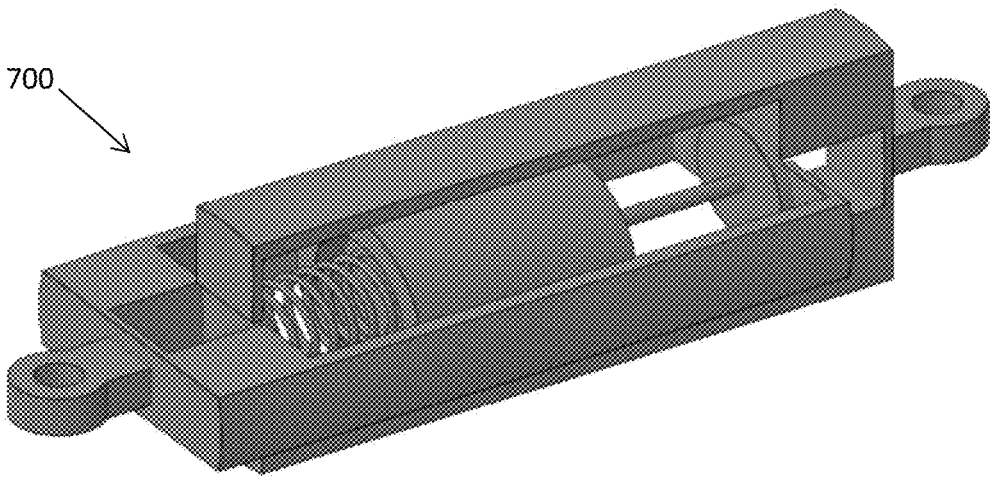
Figure 23:
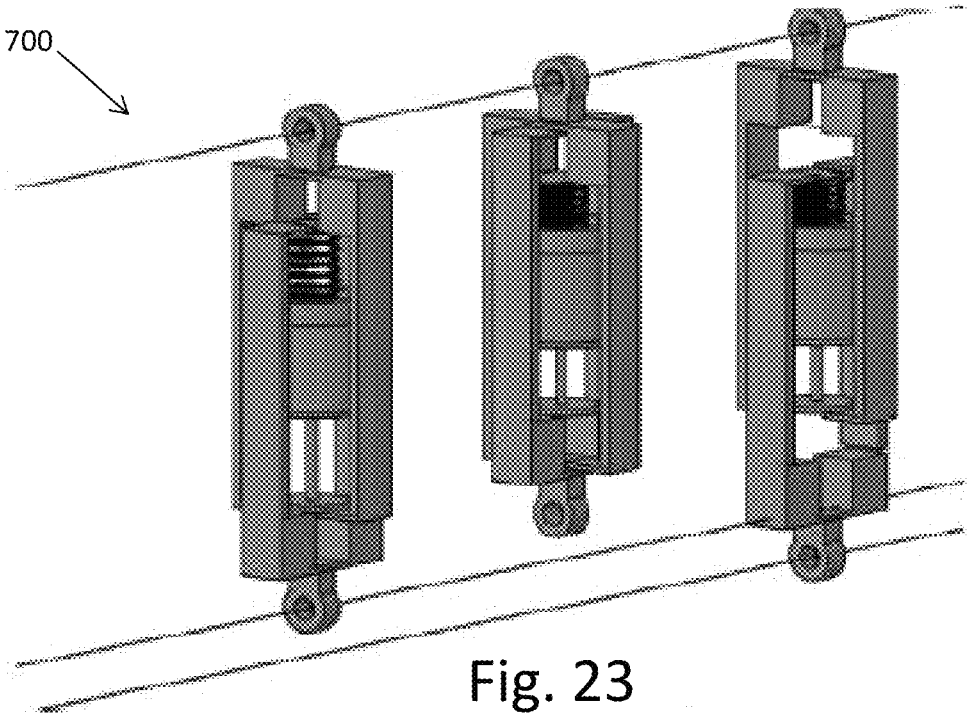
Figure 24:
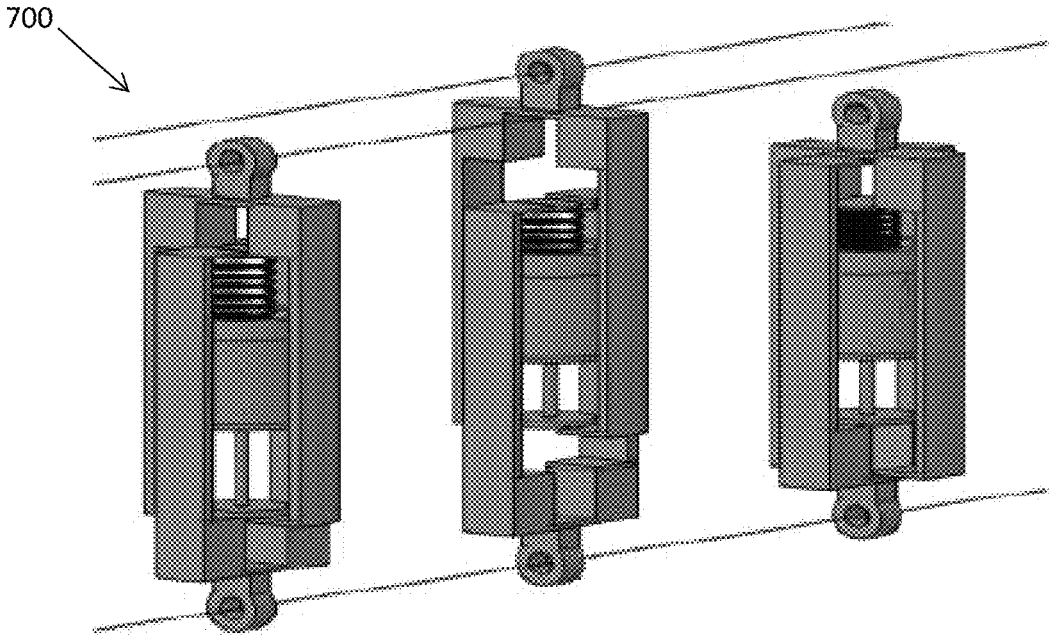

In one example, the assembly 600 can include a tension-compression GSA 700 that can generate bilinear elastic behavior in both tension and compression. FIGS. 21 and 22 depict an exemplary tension-compression GSA 700, which can be installed as a diagonal brace between points C and B' or equivalently between points C' and B of the assembly shown in FIG. 20. In this embodiment, it is possible to use only a single tension-compression GSA 700, instead of two GSA's (for example, as in the arrangement shown in FIG. 16) in order to generate bilinear elastic behavior during corresponding displacement of the assembly 600. In one particular arrangement, the tension-compression GSA 700 can have symmetric behavior in both tension and compression. The operation of this GSA is illustrated in FIGS. 23-24. Specifically, FIG. 23 shows the tension-compression GSA 700 going from a rest state, to a compressed state, and then to a tension state and FIG. 24 shows the tension-compression GSA 700 going from a rest state, to a tension state, and then to a compressed state.

Figure 25:
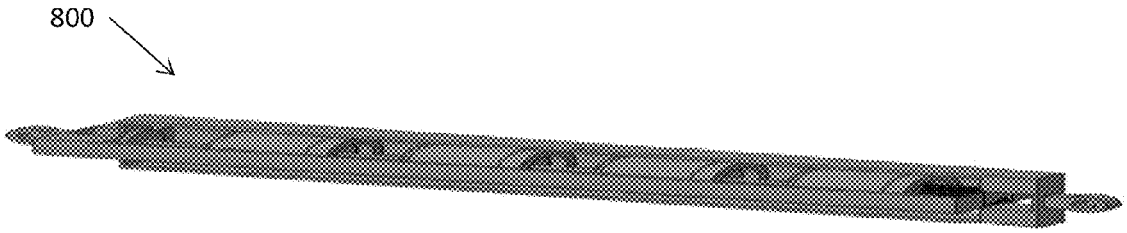
FIGS. 25-26 depict an exemplary multi-linear tension-compression gap spring assembly.
Figure 26:
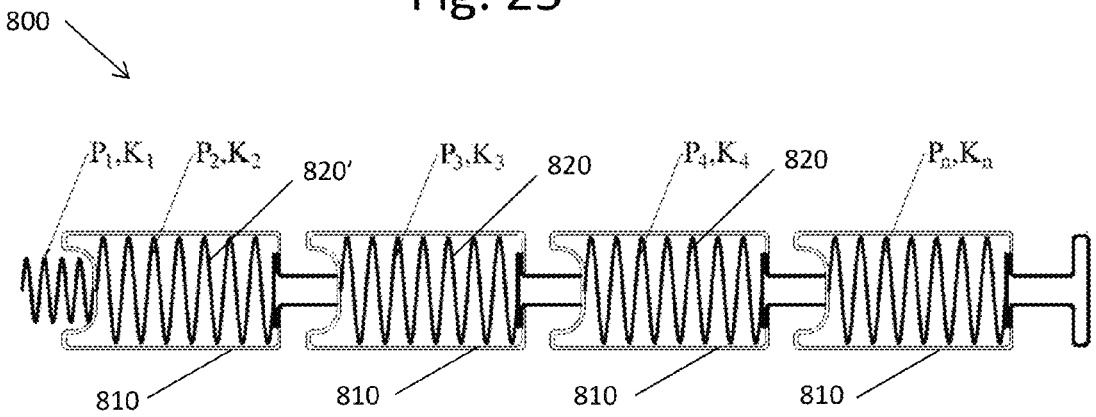

A multi-linear tension-compression GSA 800 can be used with the assembly 600. An example of a multi-linear GSA 800 is shown in FIGS. 25-26. The multi-linear GSA 800 can include a plurality of individual GSAs 810 arranged in parallel to produce a multi-linear elastic behavior. More particularly, stiffness of the GSA 800 can be initially high and reduce with increasing displacement. At large displacements, the stiffness of the GSA 800 can increase again.

Figure 27:
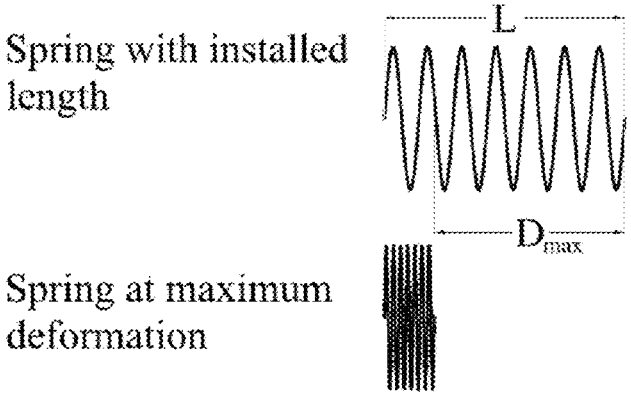
FIG. 27 depicts installation and maximum deformation of a spring in the multi-linear tension-compression gap spring assembly of FIGS. 25-26.
Figure 28:
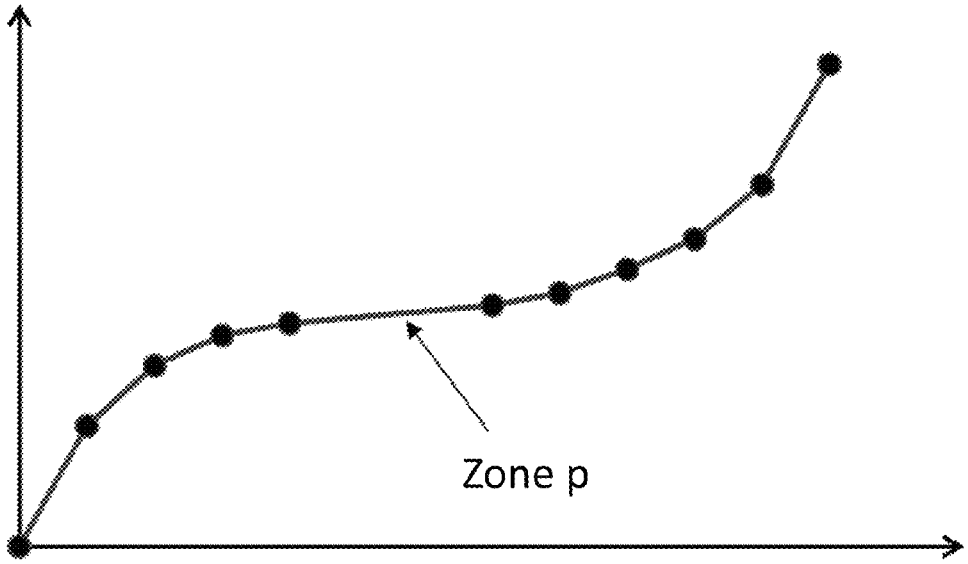
FIG. 28 is a graph of force-displacement of the multi-linear tension-compression gap spring assembly.

FIG. 26 shows the construction of a multi-linear GSA 800. As shown, the springs 820 of each individual GSA 810 can be preloaded except for spring 820'. The following condition should apply for the preload: $P_1<P_2<\ldots<P_n$. In this arrangement, stiffening occurs because the GSA springs 820 individually (i.e. one by one) can reach their displacement capacity $D_{max}$ as shown in FIG. 27. The force-displacement of the multi-linear GSA is shown in FIG. 28. The stiffness in each "zone" of the force-displacement relationship can be expressed by the following equations:

1) Stiffness K for zone n (n≤p) and prior to stiffening:

$$\frac{1}{K} = \sum_{1}^{n}\frac{1}{K_n}$$

2) Stiffness K for zone n (n>p) and after stiffening:

$$\frac{1}{K} = \sum_{n-p+1}^{n}\frac{1}{K_n}$$

The assembly 600 can include various springs between points D and D'. For example, a pre-compressed spring can be arranged points D and D' to generate negative stiffness, which has been described throughout the present description.

In another embodiment, the assembly 600 can include an "unloaded" spring between points D and D'. A brace system having an unloaded spring can have zero or relatively small initial stiffness and generate positive stiffness at large displacements. The displacement at which stiffening occurs can be dependent on geometry and the properties of the spring. Consequently, an "unloaded" spring can function as a gap element with smooth stiffening.

In another embodiment, the assembly 600 can include a spring with pre-tension between points D and D'. A system having a spring with pre-tension can generate significant positive stiffness as compared to a spring placed horizontally. The stiffness can increase with increasing displacement of the assembly 600.

Figure 29:
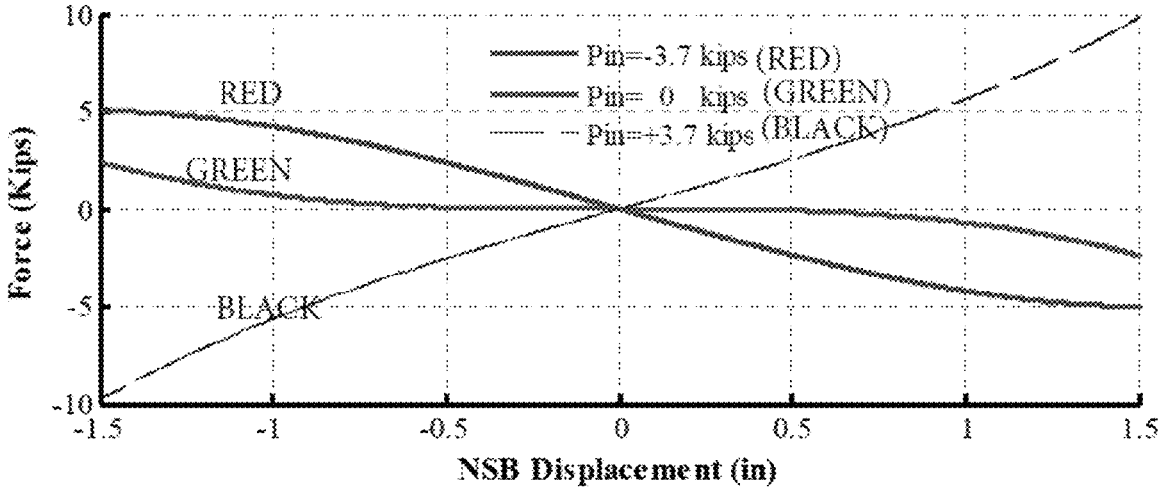
FIG. 29 are graphs of force-displacement for the assembly of FIG. 20 having various springs installed between points D and D'.

FIG. 29 depicts force-displacement curves for the assembly 600 with springs installed between points D and D' per the three embodiments described above, i.e. a pre-compressed spring, an "unloaded" spring, and a spring with pre-tension. FIG. 29 assumes that each embodiment has a spring stiffness of 0.8 k/in. The pre-compressed spring embodiment assumes a preload, $P_{in}$, of −3.7 kips; the "unloaded" spring embodiment assumes a preload, $P_{in}$, of 0 kips; and the pre-tensioned spring embodiment assumes a preload, $P_{in}$, of 3.7 kips. As will be understood, a system according to the present disclosure having a series of springs (such as the embodiment depicted in FIG. 15) may employ springs having different pre-loads (positive, negative, or zero) in order to achieve a desired behavior.

Figure 30:
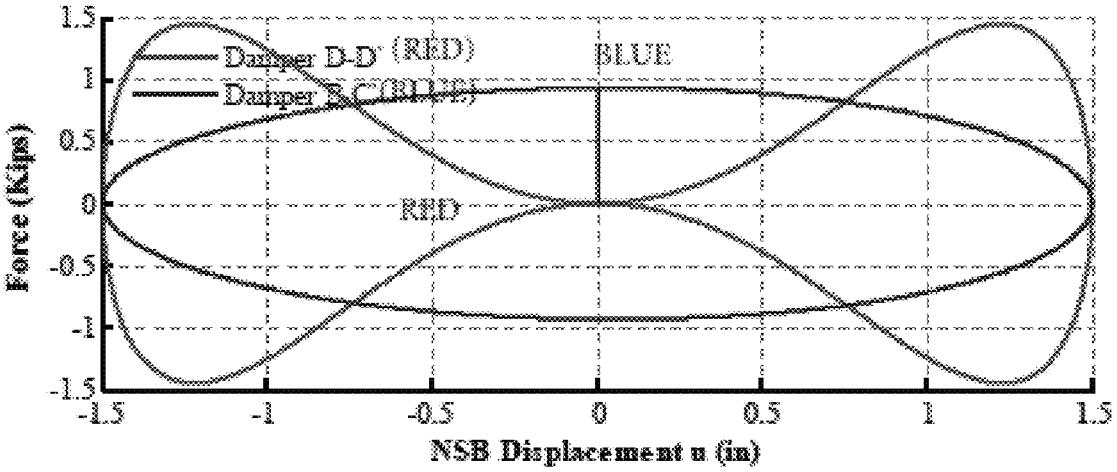
FIG. 30 are graphs of force-displacement loops for the assembly of FIG. 20 having: a damper installed between points D and D'; and a damper installed in the magnification brace between points B and C'.

A damper, such as a linear viscous damper, can be installed in assembly 600. FIG. 30 depicts the resulting force-displacement loops for the following cases: (1) a damper installed between points D and D'; and (2) a damper installed in the magnification brace between points B and C'. Thus, varying the position of a damper in a system according to the present disclosure can result in a desired change in behavior of the system.

Figure 31:
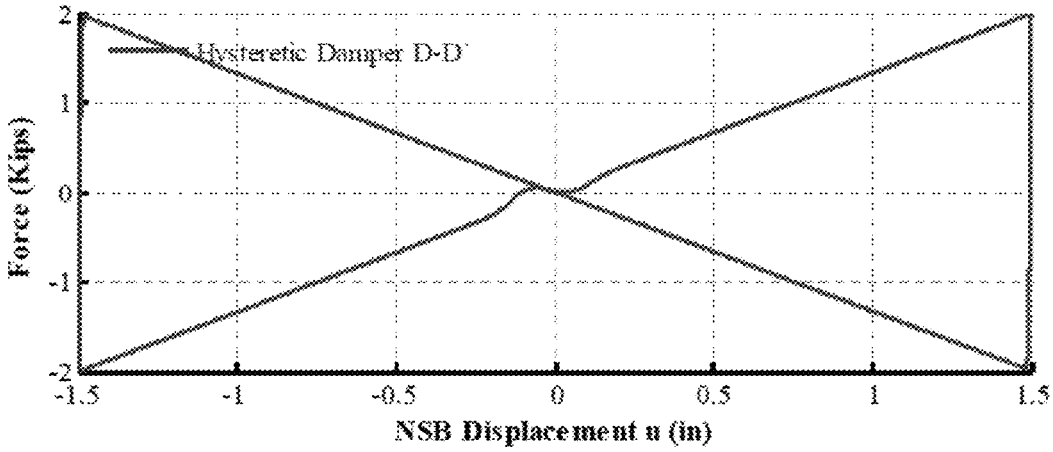
FIG. 31 is a graph of force-displacement loops for the assembly of FIG. 20 having viscous damper.

Devices, other than viscous dampers, may be used in a similar manner as viscous dampers. FIG. 31 depicts force-displacement loops similar to those of FIG. 30 when the viscous damper is replaced by a hysteretic (friction) device connected between points D and D'. Thus, a hysteric device can also be used in the assembly 600 to achieve a desired behavior of a system according to the present disclosure.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A negative stiffness system for seismic protection of a structure, comprising:

an anchor frame and a movement frame, the movement frame being laterally translatable relative to the anchor frame;

a first negative stiffness device, including:

a first linkage pivotably connected to the anchor frame at a first pivot point and pivotably connected the movement frame at a second pivot point;

a first spring having a first end operably coupled to the anchor frame and a second end operably coupled to the movement frame, the first spring having a spring force;

wherein in a rest state, the first spring is compressed to exert a preload force to the first linkage and the anchor frame and not displace the first linkage and the movement frame;

wherein in an engaged state, the first spring is configured to apply a force to the first linkage such that the movement frame is displaced in a same lateral direction of a seismic load; and wherein the first spring force is amplified by the first linkage when the frame is laterally displaced to an amplification point; and at least one additional negative stiffness device, each additional negative stiffness device including:

a second linkage pivotably connected to the anchor frame at a first pivot point and pivotably connected the movement frame at a second pivot point;

a second spring having a first end operably coupled to the first linkage of the first negative stiffness device and a second end operably coupled to the second linkage, the second spring having a second spring force;

wherein in a rest state, the second spring is compressed to exert a preload force to the first linkage and the anchor frame and not displace the first linkage and the movement frame;

wherein in an engaged state, the second spring is configured to apply a second force to the first linkage of the first negative stiffness device such that the movement frame is displaced in the same lateral direction of the seismic load; and wherein the second spring force is amplified by the first linkage when the frame is laterally displaced to the amplification point;

wherein each of the first spring and the second spring are arranged to provide a cumulative, positive force to displace the movement frame in the same lateral direction of the seismic load.

2. The negative stiffness system of claim 1, wherein in the rest state, the first spring and the second spring of the at least one additional negative stiffness device are arranged in series.

3. The negative stiffness system of claim 2, wherein in the engaged state, the first linkage of the first negative stiffness device, the second linkage of the at least one additional negative stiffness device, and the third linkage of the first negative stiffness device are configured to pivot about the anchor frame in unison.

4. The negative stiffness system of claim 1, wherein the negative stiffness system has a force-displacement relation that multiples according to a total number of springs in the negative stiffness system, the total number of springs including the first spring of the first negative stiffness device and the second spring of the at least one additional negative stiffness device.

5. The negative stiffness system of claim 4, wherein in the engaged state, the first linkage of the first negative stiffness device, the second linkage of the at least one additional negative stiffness device, and the third linkage of the first negative stiffness device are configured to rotate relative to the anchor frame in unison.

6. The negative stiffness system of claim 5, wherein in the engaged state, the first spring and the second spring are configured to rotate relative to the anchor frame in unison.

7. The negative stiffness system of claim 4, wherein the negative stiffness system has a force-displacement relationship expressed by:

$$F_{Brace} = -2\,n_s P_{in} \frac{l_1}{l_2}\left(\frac{2}{l_p}\frac{l_1}{l_2} + \frac{1}{l_2}\right)u$$

wherein:

$F_{Brace}$ is the force-displacement relationship, $n_s$ is the total number of springs in the negative stiffness system, $P_{in}$ is preload force of each of the total number of springs, u is resultant displacement distance of the movement frame relative to the anchor frame, $l_1$ is length between the second end of the second spring and the first pivot point of the second linkage, $l_2$ is length between the first pivot point of the second linkage and the second pivot point of the second linkage, and $l_p$ is length of the spring.

8. The negative stiffness system of claim 1, wherein the first negative stiffness device further comprises a third linkage pivotably connected to the anchor frame and pivotably connected the movement frame; and wherein the first end of the first spring of the first negative stiffness device is pivotably connected to the first linkage and the second end of the first spring of the first negative stiffness device is pivotably connected to the third linkage.

9. The negative stiffness system of claim 8, wherein in the engaged state, the first linkage of the first negative stiffness device, the second linkage of the at least one additional negative stiffness device, and the third linkage of the first negative stiffness device are configured to pivot about the anchor frame in unison.

10. The negative stiffness system of claim 1, further comprising at least one gap spring assembly configured to delay engagement of the first spring and the second spring by a predetermined lateral displacement.

11. The negative stiffness system of claim 10, wherein the gap spring assembly is attached between the movement frame and the anchor frame.

12. The negative stiffness system of claim 10, wherein the gap spring assembly is attached between the second pivot point of the second linkage and the first pivot point of the first linkage.

13. The negative stiffness system of claim 10, wherein the gap spring assembly includes an adjustment mechanism configured to adjust the predetermined lateral displacement.

14. The negative stiffness device of claim 1, further comprising a first gap spring assembly and a second gap spring assembly configured to delay engagement of the second spring by a predetermined lateral displacement;

wherein the first gap spring assembly is attached between the second pivot point of the second linkage and the first pivot point of the first linkage; and wherein the second gap spring assembly is attached between the first pivot point of the second linkage and the second pivot point of the first linkage.

15. The negative stiffness system of claim 1, further comprising at least one damping device configured to reduce lateral translation of the movement frame.

16. The negative stiffness system of claim 1, wherein after an initial engaged state, the lateral force increases as the movement frame is displaced in the lateral direction to a peak engaged state;

wherein after the peak engaged state, the lateral force decreases as the movement frame continues to be displaced in the lateral direction.

17. The negative stiffness device of claim 16, wherein lateral displacements between the initial engaged state and the peak engaged state the negative stiffness device exerts a negative stiffness, and in lateral displacements above the peak engaged state, the negative stiffness device exerts a positive stiffness.

18. A negative stiffness system for seismic protection of a structure, comprising:

an anchor frame and a movement frame, the movement frame being laterally translatable relative to the anchor frame;

a first negative stiffness device, including:

a first linkage pivotably connected to the anchor frame at a first pivot point and pivotably connected the movement frame at a second pivot point;

a first spring having a first end operably coupled to the anchor frame and a second end operably coupled to the movement frame, the first spring having a spring force;

wherein in a rest state, the first spring is compressed to exert a preload force to the first linkage and the anchor frame and not displace the first linkage and the movement frame;

wherein in an engaged state, the first spring is configured to apply a force to the first linkage such that the movement frame is displaced in a same lateral direction of a seismic load; and wherein the spring force is amplified by the first linkage when the frame is laterally displaced to an amplification point at least one additional negative stiffness device, each additional negative stiffness device including:

a second linkage pivotably connected to the anchor frame at a first pivot point and pivotably connected the movement frame at a second pivot point;

a second spring having a first end operably coupled to the first linkage of the first negative stiffness device and a second end operably coupled to the second linkage, the second spring having a second spring force;

wherein in a rest state, the second spring is compressed to exert a preload force to the first linkage and the anchor frame and not displace the first linkage and the movement frame;

wherein in an engaged state, the second spring is configured to apply a second force to the first linkage of the first negative stiffness device such that the movement frame is displaced in the same lateral direction of the seismic load; and wherein the second spring force is amplified by the first linkage when the frame is laterally displaced to the amplification point;

a first gap spring assembly and a second gap spring assembly configured to delay engagement of the second spring by a predetermined lateral displacement;

wherein the first gap spring assembly is attached between the second pivot point of the second linkage and the first pivot point of the first linkage; and wherein the second gap spring assembly is attached between the first pivot point of the second linkage and the second pivot point of the first linkage;

wherein in the engaged state, the first spring and the second spring are configured to rotate relative to the anchor frame in unison;

wherein each of the first spring and the second spring are arranged to provide a cumulative, positive force to displace the movement frame in the same lateral direction of the seismic load.

19. The negative stiffness system of claim 18, wherein the anchor frame and the movement frame are attached to a structure.

20. A negative stiffness system for seismic protection of a structure, comprising:

an anchor frame and a movement frame, the movement frame being translatable relative to the anchor frame;

a first negative stiffness device, including:

a first linkage pivotably connected to the anchor frame at a first pivot point and pivotably connected the movement frame at a second pivot point;

a first spring having a spring force;

wherein in a rest state, the first spring is compressed to exert a preload force to the first linkage and the anchor frame;

wherein in an engaged state, the first spring is configured to apply a force to the first linkage such that the movement frame is displaced in a same lateral direction of a seismic load;

a second negative stiffness device including:

a second linkage pivotably connected to the anchor frame at a first pivot point and pivotably connected the movement frame at a second pivot point;

a second spring having a second spring force;

wherein in a rest state, the second spring is compressed to exert a preload force to the first linkage and the anchor frame;

wherein in an engaged state, the second spring is configured to apply a second force to the first linkage of the first negative stiffness device such that the movement frame is displaced in the same lateral direction of the seismic load; and wherein each of the first spring and the second spring are arranged to provide a cumulative, positive force to displace the movement frame in the same lateral direction of the seismic load.

* * * * *